US010322066B2

(12) United States Patent
Thach et al.

(10) Patent No.: US 10,322,066 B2
(45) Date of Patent: Jun. 18, 2019

(54) MEDICATION DISPENSING SYSTEM

(71) Applicant: Accredo Health Group, Inc., Memphis, TN (US)

(72) Inventors: Christina J. Thach, Webster Groves, MO (US); Charles E. Eller, Lake Saint Louis, MO (US); Mark G. Bini, O'Fallon, MO (US); Terry Griffith, Germantown, TN (US); Jacob J. Reinhardt, Wentzville, MO (US); Kristin Trower, St. Louis, MO (US); Stefanie Pitts, Arlington, TN (US)

(73) Assignee: Accredo Health Group, Inc., Memphis, TN (US)

( * ) Notice: Subject to any disclaimer, the term of this patent is extended or adjusted under 35 U.S.C. 154(b) by 241 days.

(21) Appl. No.: 15/259,983

(22) Filed: Sep. 8, 2016

(65) Prior Publication Data

US 2017/0065488 A1 Mar. 9, 2017

Related U.S. Application Data

(60) Provisional application No. 62/215,259, filed on Sep. 8, 2015, provisional application No. 62/232,401, filed on Sep. 24, 2015.

(51) Int. Cl.
*A61J 7/04* (2006.01)
*A61J 7/00* (2006.01)

(52) U.S. Cl.
CPC ..... *A61J 7/0481* (2013.01); *A61J 7/0084* (2013.01); *A61J 7/0418* (2015.05); *A61J 7/0454* (2015.05); *A61J 7/04* (2013.01)

(58) Field of Classification Search
CPC ..... A61J 7/00; A61J 7/0007; A61J 7/0015; A61J 7/0023; A61J 7/003; A61J 7/0038; A61J 7/0046; A61J 7/0053; A61J 7/0061; A61J 7/0069; A61J 7/0076; A61J 7/0092; A61J 7/02; A61J 7/0409; A61J 7/0427;
(Continued)

(56) References Cited

U.S. PATENT DOCUMENTS 3,497,982 A * 3/1970 Schulz ..... B65D 25/36 206/459.5
4,775,077 A 10/1988 Capotorto
(Continued)

FOREIGN PATENT DOCUMENTS

DE 3306399 A1 10/1984
GB 2122578 A 1/1984
WO 2013/142351 A1 9/2013

*Primary Examiner* — Gene O Crawford
*Assistant Examiner* — Ayodeji T Ojofeitimi
(74) *Attorney, Agent, or Firm* — Dickinson Wright PLLC

(57) ABSTRACT

Methods and systems for a drug supply with an associated dosage regimen are described. A plurality of dosage containers are sequentially stored in drug boxes. The dosage containers are associated with a first time of treatment. The drug boxes are associated with a certain recurring time, e.g., morning, afternoon and evening or four boxes associated with four times a day. The entire day is covered by a plurality of drug boxes for treatment. This organizes the drugs such that compliance with complex treatment regimens may be increased. The drugs in each of the dosage containers need not be the same dosage or even the same drugs each time.

22 Claims, 12 Drawing Sheets

(58) Field of Classification Search
CPC ..... A61J 7/0436; A61J 7/0445; A61J 7/0463; A61J 7/0472; A61J 7/049
See application file for complete search history.

(56) References Cited

U.S. PATENT DOCUMENTS

| | | | | |
|---|---|---|---|---|
| 5,597,072 | A * | 1/1997 | Lieberman | A61J 1/03 206/531 |
| 6,082,544 | A | 7/2000 | Romick | |
| 6,234,433 | B1 * | 5/2001 | Maglione | A47F 5/112 248/135 |
| 6,733,095 | B1 | 5/2004 | Rieb | |
| 6,988,619 | B2 * | 1/2006 | Klatt | A61J 1/035 206/232 |
| 7,866,476 | B2 | 1/2011 | McGonagle et al. | |
| 8,550,248 | B1 | 10/2013 | Busen | |
| 9,241,873 | B2 | 1/2016 | Upchurch et al. | |
| 2005/0150809 | A1 | 7/2005 | Pile | |
| 2008/0128450 | A1 | 6/2008 | O'Gorman et al. | |
| 2008/0272022 | A1 * | 11/2008 | Kulkarni | A61J 1/035 206/532 |
| 2009/0010575 | A1 * | 1/2009 | Sanka | A45C 11/00 383/25 |
| 2009/0139893 | A1 * | 6/2009 | McGonagle | A61J 1/035 206/531 |
| 2010/0206765 | A1 * | 8/2010 | Fonte | A61J 7/04 206/534 |
| 2010/0314282 | A1 * | 12/2010 | Bowers | A61J 1/03 206/534 |

* cited by examiner

MEDICATION DISPENSING SYSTEM

This application claims the benefit of U.S. Provisional Application No. 62/215,259, filed Sep. 8, 2015, and 62/232,401, filed Sep. 24, 2015, both of which are hereby incorporated by reference in their entirety.

FIELD

The field relates to medication dispensing, and more particularly to packaging prescription drugs.

BACKGROUND

Medical progress has developed pharmaceutical drugs that treat a variety of different types of illnesses. Many people are prescribed a once or twice a day drug regimen for certain diseases and at least attempt to maintain compliance with such a regimen.

Some drug therapies require more complex drug regimes. While some drug therapies utilize over the counter or prescription drugs, other drugs have a more expensive or complex therapy often associated with specialty pharmaceutical drugs. So called specialty drugs may be used to treat a chronic or difficult health condition, like multiple sclerosis or rheumatoid arthritis. In these cases, which may include a bottle or multiple bottles with different dosing regimens, a patient must track and take their drugs as prescribed. Failure to comply with the dosing regimens for these conditions could result in hospitalization, a failure to be cured, an additional and/or exacerbation of an existing serious health condition, or death. Adherence to the dosing regimen may be more challenging when the drug dosing schedule is complex or when the patient is a child or has special needs. As a result, compliance with the drug regimen may drop with an associated non-optimal outcome for the patient. Moreover, in the cases of specialty drugs, additional reporting and monitoring may be required.

SUMMARY

A medication dispensing device is described and may include a plurality of drug containers each storing therein at least one sachet including at least one medication or pharmaceutical dose therein. The plurality of drug containers are positioned or organized in an order of treatment. The sachet(s) for each drug container may store a first pharmaceutical dose that is different from a second pharmaceutical dose stored in a second sachet in another of the plurality of drug containers. The drug box may include a plurality of box walls defining an interior that extends vertically and is configured to store the plurality of drug containers in the ordered configuration. A front wall of the plurality of box walls may include a level indicator to view a remaining amount of drug containers in the interior of the box, a removed amount of the drug containers from the box or both. A dose tracker may be included to allow a user to indicate the drugs taken. A dispensing aperture is in at least one wall to allow the next drug container of the plurality of drug containers to be removed from the interior of the box.

In an example embodiment, the dispensing aperture is sized to allow a single one of the plurality of drug containers to be removed from the interior of the box at a time.

In an example embodiment, the dispensing aperture is positioned adjacent a bottom of the box with the next drug container for supply a treatment to a patient at the dispensing aperture. The next drug container may be associated with a topmost indicator at the level indicator and an upper one indicator of the dose tracker that has not yet been tracked.

In an example embodiment, a drug container of the plurality of drug containers includes a medication storing bag.

In an example embodiment, the drug container of the plurality of drug containers is a dosage box sized such that a single dosage box is removed through the aperture at one time.

In an example embodiment, the drug container of the plurality of drug containers includes a tray with an opening and an outer casing to removably close the opening in the tray such that the medication in the tray is enclosed until after the outer casing is removed from the tray.

In an example embodiment, the outer casing is slidable on the tray and a construction of the outer casing and the tray is sized to allow a single assembly of one tray and one outer casing to be removed through the dispensing aperture at one time.

In an example embodiment, the plurality of drug containers includes at least one placebo drug container that does not have a pharmaceutical active ingredient to treat a patient.

In an example embodiment, each of the drug boxes is associated with each time period in a day that a drug must be taken, In an example embodiment, each drug container in a respective box contains an item to be taken at a same time each day. The item can be the drug or a placebo.

In an example embodiment, the sachet stores a drug dosage that is based on weight of the patient.

In an example embodiment, the sachet stores a greater number of pills for a heavier patient than a number of pills for a lighter patient.

A medication dispensing device or system is described herein and may include a plurality of drug containers storing therein at least one sachet including at least one medication therein. The drug containers include drugs needed for a single dose according to a same time during a drug treatment regime. The number of dispensing boxes may be equal to the number of medication dispensing actions taken during at the same time over a time period of the drug treatment regime. Each dispensing box may include a plurality of walls defining an interior that extends vertically and stores the plurality of drug containers. The drug containers in a first dispensing box of the plurality of dispensing boxes need not store a same drug type or a same drug dosage. A dispensing aperture is positioned in at least one of plurality of walls to allow a single one of the drug containers to be removed from the interior of the dispensing box. A connector is to secure the plurality of dispensing boxes together with the plurality of dispensing boxes representing a drug therapy regimen.

In an example embodiment, the plurality of walls each include a front wall. The front wall may include a level indicator to view a remaining amount of drug in the interior of the box, a removed amount of drug from the box, or both, and a dose tracker to allow a user to indicate the drugs taken from the associated dispensing box.

In an example embodiment, the dispensing aperture is positioned adjacent a bottom of the dispensing box with the drug container at the dispensing aperture being associated with a topmost indicator at the level indicator and an upper one of the dose trackers such that the last drug container is aligned with the indicator for the drug container at the dispensing aperture.

In an example embodiment, the drug container includes a medication storage bag.

In an example embodiment, the connector includes a foot assembly to assist in holding the plurality of boxes upright.

In an example embodiment, the foot assembly is moveable from a stand-assist position and a retracted position for transportation.

In an example embodiment, the foot assembly includes at least one side wall that extends along a lateral wall of an outer most one of the plurality of box walls.

In an example embodiment, the drug containers include a closed dosage boxes that each contains a scheduled dose of medication.

In an example embodiment, the plurality of dispensing boxes store therein a set of drug containers containing a drug dosage to be taken at same time each day.

In an example embodiment, the connector includes a backing behind the plurality of dispensing boxes and the foot assembly is pivotably joined to the backing to allow the foot assembly to pivot from the retracted position to the stand assist position.

DETAILED DESCRIPTION

Example methods and systems for medication delivery are described. The methods and systems may provide for shipment and delivery of the drugs, e.g., specialty drugs, while further providing for dosing instructions and tracking. The present medication delivery system allows those patients with complex drug treatment regimens to have a systematic delivery of their drugs. The present medication delivery system may increase compliance with the drug treatment regimen. In some drug treatment regimens there may be changes in the type of drug or a dosage amount at a certain time of day or a change over a longer time period, e.g., changing the drug dosage amount or drug type over the course of weeks or the regimen time period.

The present disclosure describes assemblies that organize drugs, pharmaceuticals, and placebos (if needed) over the course of the treatment. Individual containers are prepared for each dosage time and date. The individual containers are stored in boxes that represent a same treatment time over a longer time period, e.g., a time of day. The patient need only remove the individual container for that dosage time at the same day and time for each dose. The patient takes all of the contents in the container. The dose in each container may be the same as some of other containers but, in an example embodiment, a container may have different contents, e.g., different drugs or different dosages, than other containers.

Figure 1:
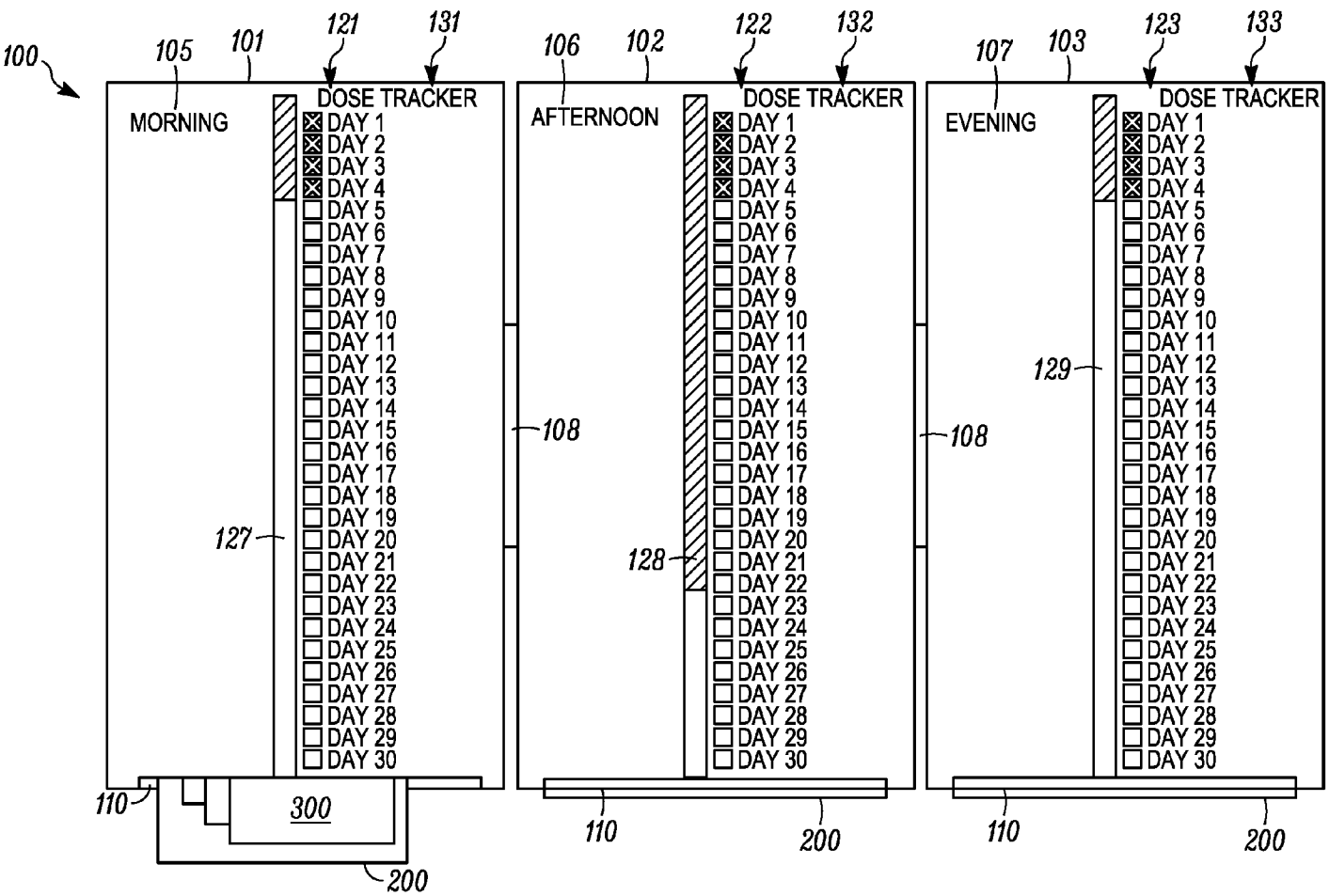
FIG. 1 is a view of a medication dispensing device, according to an example embodiment.

FIG. 1 is a view of a drug package 100, according to an example embodiment. The drug package 100 includes one drug box or multiple drug boxes 101, 102, 103. While three drug boxes 101, 102, 103 are shown in FIG. 1, other configurations including different number of drug boxes may be provided (e.g., based on dosing times during the day). For example, if a drug regimen is to have a patient take a drug three times a day but in different dosages at the different times, then the different times can be represented in different boxes, respectively. The number of drug boxes can be equal to the number of times per a time period (e.g., a day) that drugs are taken according to the drug treatment regimen. For example, if a patient must take drugs twice a day, then there are two boxes. If a patient must take drugs four times a day, then there are four boxes. The number of boxes may equal the maximum number of times in the time period (e.g., a day) that a patient takes a drug during the time period over the entire drug therapy time.

The drug boxes 101, 102, 103 are configured to organize drugs for dispensing to a patient. The drug boxes 101, 102, 103 may be joined together by a fastener 108. Examples of fasteners include adhesives, tapes, hook and loop fasteners, an outer container in which the boxes will fit, bayonet connectors, latches, and the like. In some embodiments, the drug boxes 101, 102, 103 may be selectively joined and detached from one another. In some embodiments, the drug boxes 101, 102, 103 are joined such that they may not be selectively joined, detached, and rejoined. A single housing may surround all three drug boxes 101, 102, 103 to effectively join the drug boxes 101, 102, 103 together. In an example, the housing is a band or box that surrounds the boxes 101, 102, 103. In some embodiments, the drug boxes 101, 102, 103 are provided individually and not provided with a mechanism for joining and/or detaching.

The drug boxes 101, 102, 103 are configured to store therein multiple dosage containers 200, e.g., dosage bags, boxes, blister packs, and the like (explained in greater detail below, e.g. in FIGS. 2 and 3), which may store one or multiple pills or other pharmaceutically measured structures for delivery of a prescription pharmaceutical, over the counter medication, placebos and the like. The dosage containers 200 are configured to hold one complete dose according to the drug regimen. The dose may include multiple drugs, drug strengths, and different drug types. The drug boxes 101, 102, 103 may be formed by walls with a hollow interior in which the dosage containers 200 are loaded. The drug boxes 101, 102, 103 may include four elongate vertical walls, a top, and a bottom to define the interior, which can extend vertically. The top or bottom may be openable to insert the dosage containers therein. The dosage containers being positioned or arranged in a treatment order according to the regimen. The walls may be forming of a rectangular prism structure around the open interior. The dosage containers 200 may be stored in a vertically stacked configuration within the interior of the drug boxes 101, 102, 103. The stacked configuration may be with the dosage containers 200 in a horizontal orientation with any indicia on the dosage container facing upwardly and the dosage containers 200 stacked one on top of the other. A first dosage container 200, in an example embodiment, is positioned at the bottom of the stack and the last dosage container may be at the top of the stack. The dimensions of the interior of the drug boxes 101, 102, 103 are generally the same as the length and width of the dosage container 200 to be stored therein. A dispensing aperture 110 may be positioned at the bottom end of each drug box 101, 102, 103, e.g., in a front wall of the drug box. The dispensing aperture 110 is sized so that one dosage container 200 is visible or accessible from outside the drug boxes 101, 102, 103. For example, the dispensing aperture 110 has a height equal to the thickness of one dosage container 200 and a width equal to the width of one dosage container 200. In some instances, a given dosage container 200 may be slightly thicker than the height of the dispensing aperture 110. In such a case, the walls of the drug box 101, 102, 103 may yield to allow the dosing container 200 to pass through the aperture. The container 200 may also be formed of material that will yield to a force being applied to it when gripped by a person and pulled through the dispensing aperture 110.

Each drug box 101, 102, 103 may represent a certain time of day (e.g., morning, afternoon, and evening, etc.) at which a drug may be taken during an extended time period. The extended time period can be the time of drug treatment in the regime or the duration of a prescription, which may be refilled. For example, the drug boxes 101, 102, 103 may be taken over a 30-day period, a 60-day period, or a 90-day period. Other time periods of greater or lesser number of times may be reflected with the drug boxes 101, 102, 103. The first box 101 may store all of the drugs to be taken at a same first time over a sub-time period, for example at least part of the extended time period. The second box 102 may store all of the drugs to be taken at a same second time over the sub-time period. The third box 103 may store all of the drugs to be taken at a same third time over the sub-time period. For example, the extended time period may be a week, a month, 60 days, 3 months, a year or other time period greater than a day. The sub-time period is generally less than the time period. The sub-time period may be a day. During each day, the drugs stored in the first drug box 101 are to be taken in the morning; the drugs stored in the second drug box 102 are to be taken in the afternoon; and the drugs stored in the third drug box 103 are to be taken in the evening. If there are greater divisions in a day, additional drug boxes may be provided.

Each of the drug boxes 101, 102, 103 includes respective indicia 105, 106, 107 to indicate that the drugs contained therein are to be taken at a certain interval. The indicia 105, 106, 107 may include a printed label, a coloring on the drug box, the complete color of the drug box, an image, an icon, or the like. As shown in FIG. 1, the box 101 includes indicia 105 reflecting that the medicine contained within the drug box should be taken in the morning. The indicia 105 is distinctive relative to the indicia 106, 107 on the other drug boxes 102, 103 in the drug package 100. The distinctive indicia 105 includes a first color (e.g., green) and at least one term (e.g., "morning"). The indicia 106 of drug box 102 reflects that the medicine contained within the drug box 102 should be taken in the afternoon. The indicia 106 is distinctive relative to the indicia 105, 107 on the other boxes 101, 103 in the drug package 100. The distinctive indicia 106 includes a second color (e.g., purple) and at least one term (e.g., "afternoon"). The indicia 107 of the drug box 103 indicates that the medicine contained within the drug box 103 should be taken in the evening. The indicium 107 is distinctive relative to the indicia 105, 106 on the other drug boxes 101, 102 in the drug package 100. The distinctive indicium 107 includes a third color (e.g., blue, etc.) and at least one term (e.g., "evening").

The drug boxes 101, 102, 103 further include respective dose trackers 121, 122, 123, on the front face to indicate that the drugs in the drug box have been taken, or removed from the box. The dose tracker can provide visual reference of the treatment regimen. The dose trackers 121, 122, 123 show from the top down the level of the dosage containers 200 remaining in the drug box 101, 102, 103. The dose trackers 121, 122, 123 respectively include level indicators 127, 128, 129 and sub-time period lists 131, 132, 133. The level indicator 127, 128, 129 can be a window in the front face of the respective box 121, 122, 123. The window of the level indicator 127, 128, 129 can be an aperture in the wall of the front face. The window can be open through the wall of the front face. The window can include a transparent covering to close the opening but allow a person to see the contents, e.g., the drug containers, in the drug box 101, 102, 103.

The dose trackers 121, 122, 123 each include a listing of the number of dosage containers 200 and a check box that can be ticked or otherwise marked to indicate that the drug dose has been taken. The dose trackers 121, 122, 123 allow the patient to track which medications have been taken versus the dosage containers 200 that have been removed from the respective box 101, 102, 103. A patient may remove one or multiple dosage containers 200, e.g., to deposit with a school nurse or other caregiver, and not take the drug. After taking the drug, then the patient may mark the check box on the time period list. This tracking mechanism provides an easy record to follow and report back to the patient's medical team.

In some embodiments, one or more than one of the drug boxes 101, 102, 103 may be replicated and split such that a portion of the dosing containers 200 are in a first drug box 101 and a remaining portion of the dosing containers is in a second drug box 101. The first drug box 101 may be in a first location (e.g., a home of the patient) and the second drug box 101 may be in a second location (e.g., a school nurse's office, day care, or work location of the patient). The first and second drug box 101 may include empty containers when the particular drug box 101 does not have the dosing containers 200 with medication for the particular dosing day and time. Additional indicia may be included on such dosing containers 105 (e.g., a big black X) or a placebo (e.g., a sugar pill, a piece of candy, or a vitamin) may be included within such dosing containers 105 to reflect that a particular dosing or dosings do not have medication.

The dosage containers 200, e.g., bags, small boxes or the like, are stacked in the drug boxes 101, 102, 103 in the reverse order, with the dosage container 200 for the first day being at the bottom of the box adjacent the dispensing aperture 110. The last dosage container 200 is at the top of the stack in the boxes 101, 102, 103. Thus, the dosage containers 200 are ordered as 1, 2, 3, . . . n−1, n, with n being the last dosage container 200.

Figure 2A:
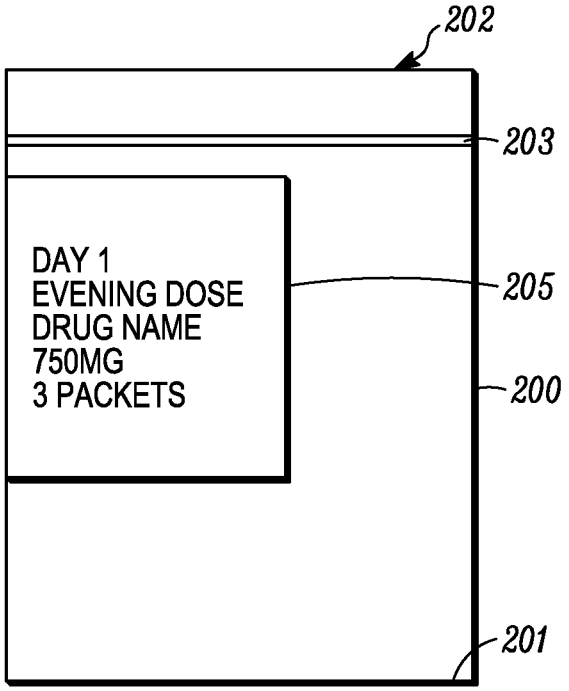
FIG. 2A is a plan view of a dosage bag that may be deployed within the drug package of FIG. 1, according to an example embodiment.
Figure 2B:
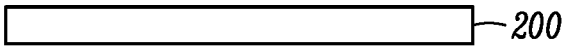
FIG. 2B is a side view of the FIG. 2A dosage bag.

FIG. 2A and FIG. 2B are a plan view and a side view, respectively, of a dosage container 200 that includes a body 201 that forms a recess with an open top 202. The recess in the bag 200 is enclosed by the body 201. The body 201 may be a polymer that is at least partially transparent so that the contents of the dosing container 200 can be visually inspected. The body 201 may be a paper product, e.g., with a clear window therein such that the drugs may be visually see from outside the dosing bag 200. The recess is adapted to hold one or multiple drugs and/or one or multiple sachets 300 (FIGS. 3A and 3B) containing a single drug or multiple drugs, e.g., a pill or multiple pills. A seal 203 is provided at the open top 202 to close the recess when a drug is being stored in the dosage container 200. The seal 203 extends the entire length of the open top 202. In another example, the seal 203 and opening into the dosage container 200 may be positioned in one planar side of the dosage container 200. The seal 203 may be a one-time use seal such that when the seal 203 is opened the container 200 may not be reclosed. The seal 203 may include perforations in the body of the dosage container 200 that guide the mechanical separation of the body of the dosage container. In another example embodiment, the seal 203 may be a resealable seal. The seal 203 may be formed directly in the body 201, e.g., by thermoforming. The seal may be a double track seal or a zipper type seal. The seal 203 may also be a tape that extends over the open top 202. The part of the body 201 at the open top 202 may be folded down onto the body 201 and seal may be an adhesive or tape that holds the open top onto the body 201. Other types of mechanisms to seal the dosing bag 200 may also be used.

An information area 205 is provided on the dosing containers 200. The information area 205 may include a sticker or label adhered to the outer surface of the container body 201. The information area 205 may be part of the dosage container 200 that has a surface prepared to display information to be read by the patient on the dosing regimen associated with the drug package 100, a caregiver of such a patient, or otherwise (e.g., a parent, a spouse, or a prescriber of the patient). The container body 201 may allow the information to be printed or lased or etched on the information area 205. The information area 205 may provide a surface adapted to receive a label, printing, or marking. In the case of printing, the information area 205 may provide a contrast to the print to allow the data thereon to be more easily viewed relative to the remainder of the dosage container 200. Information within the information area 205 may include, by way of example, the date or the dose day indicator, a dose time, the drug name, the drug strength and the number of packets, drugs, or sachets in the specific dosage container, e.g., a flexible sided bag or a box with a rigid side. Information beyond the drug may also be included in the information area 205. For example, the patient, the treatment location, the prescriber, the filling pharmacy, and/or adherence messaging may also be included within the information area 205. In some embodiments, images may be include with the information area 205 (e.g., to facilitate adherence). Each individual dosage container 200 may be different from other dosage containers that are stored in the dispensing box 101, 102, 103 or in other additional boxes in the drug package 100. The drug dosage within the information area 205 may be the entire drug dose in the dosage container 200. The dosage container 200 may include a single drug type or may include multiple different drug types. Each drug name and drug dose may be included within the information area 205.

Figure 3A:
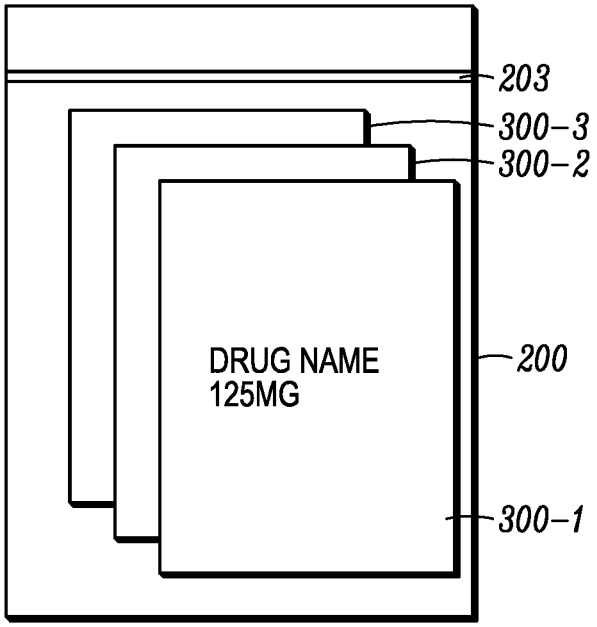
FIG. 3A is a view of a dosage bag loaded with sachets that may be deployed within the system of FIG. 1, according to an example embodiment.
Figure 3B:
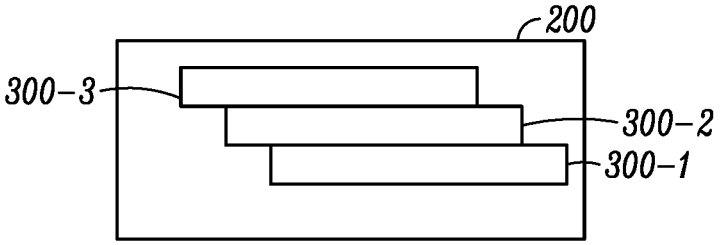
FIG. 3B is a side view of the FIG. 3A dosage bag with sachets.

FIG. 3A and FIG. 3B are a plan view and a side view, respectively, of a dosage container 200 loaded with one or more sachets 300. Each sachet 300-1, 300-2, . . . 300-N is a container for an individual dose of a drug or drugs to be taken at a specific time. The drug dose may be an incremental quantity of a drug, shown here as 125 mg of a drug. There are three sachets 300 illustrated, i.e., N=3, so if the sachets include the same drug and the same dose then the dosage container 200 contains 375 mg of that drug. However, the sachets need not contain the 300 same drug and/or the same quantity of the drug. For example, two sachets 300 may contain a first amount of a drug, e.g., 125 mg, and a third sachet 300 may contain a second quantity, e.g., 500 mg. Thus, the dosage container 200 contains a non-multiple quantity of a drug relative to a sachet, here, e.g., 750 mg of the drug. The sachets 300 may hold a drug or multiple drugs in a variety of forms, e.g., powder, pill, capsule, gel cap and the like.

While the term sachet 300 to refer to a mechanism use to store a pharmaceutical drug, other mechanisms may be used to store pharmaceutical drugs in addition to or instead of the sachets 300. The use of dosage containers 200 have different quantities of drugs and/or different types of drugs, e.g., based on the sachets therein, during the time period associated with the drug package 100 (e.g., on a day over day basis, on a week over week basis, during different time periods of the day, or otherwise). As such, the drug package 100 enables patients to more easily manage a complex drug treatment regimen. Drug package 100 may assist in improving dispensing with a prescribed treatment regimen.

The drug package 100 may thus be customized per patient, per treatment period, and/or per drug treatment regimen. The customization may enable a patient to justifiably rely on the construction and appearance of the drug boxes 101, 102, 103 to know whether the patient is being adherent with the drug treatment regimen and that the drug treatment regimen has properly been constructed (e.g., as prescribed by the prescriber for the patient).

Figure 4:
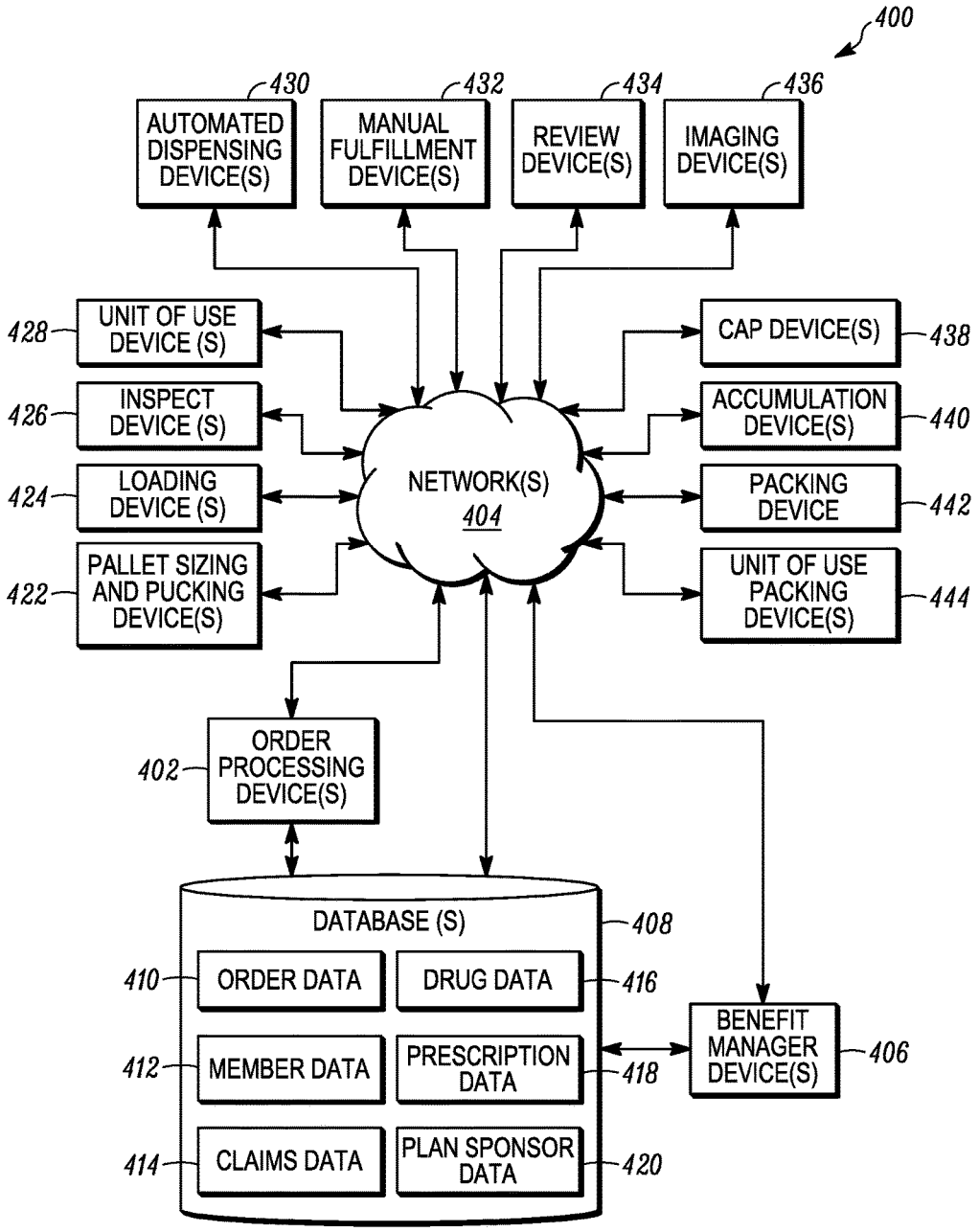
FIG. 4 is a block diagram of an example system, according to an example embodiment.

FIG. 4 illustrates a block diagram of an example system 400, according to an example embodiment. While the system 400 is generally described as being deployed in a high volume fulfillment center (e.g., a mail order pharmacy, a direct delivery pharmacy, and the like), the system 400 and/or components thereof may otherwise be deployed. The system 400 is an example system where the drug package 100 may be filled and/or a drug package 100 constructed as described herein. The system 400 may also operate to distribute the drug package 100 to a patient. However, the drug package 100 may otherwise be filled and/or constructed. For example, a pharmaceutical drug manufacture or a third party that is not the pharmacy or the drug manufacturer may fill and/or construct the drug package 100 or components of the drug package. In an example, the drug box 100 is constructed at the pharmacy using binding machines, drug pill counters, sealing machines, folding machines, printers, or the like.

The system 400 may include an order processing device 402 in communication with a benefit manager device 406 over a network 404. Additional devices which may be in communication with the benefit manager device 406 and/or the order processing device 402 over network 404 include: database(s) 408 which may store one or more than one of order data 410, member data 412, claims data 414, drug data 416, prescription data 418, and plan sponsor data 420; pallet sizing and pucking device(s) 422; loading device(s) 424; inspect device(s) 426; unit of use device(s) 428; automated dispensing device(s) 430; manual fulfillment device(s) 432;

review device(s) 434; imaging device(s) 436; closing device(s) 438; accumulation device(s) 440; packing device(s) 442; and unit of use packing device(s) 444. The system 400 may also include additional devices.

The order processing device 402 may receive information about prescriptions being filled at a pharmacy in which the order processing device 402 is deployed. In general, the order processing device 402 is a device located within or otherwise associated with a pharmacy location to enable fulfillment of a prescription by dispensing prescription drugs. In some embodiments, the order processing device 402 may be a device separate from a pharmacy that enables communication with other devices located within a pharmacy. For example, the order processing device 402 may be in communication with another order processing device 402 and/or other devices 422-444 located with a pharmacy. In some embodiments, an external pharmacy order processing device 402 may have limited functionality (e.g., as operated by a patient requesting fulfillment of a prescription drug) when an internal pharmacy order processing device 402 may have greater functionality (e.g., as operated by a pharmacy).

The order processing device 402 may track a prescription order as it is fulfilled. A prescription order may include one or more than one prescription to be filled by the pharmacy. The order processing device 402 may make pharmacy routing decisions and/or order consolidation decisions for a prescription order. The pharmacy routing decisions include what device or devices in the pharmacy are responsible for filling at least a portion of the prescription order, where the order consolidation decisions include whether portions of a prescription order or multiple prescription orders should be shipped together for a patient or a patient family. The order processing device 402 may operate in combination with the benefit manager device 406. The order processing device 402 will track the individual dosage containers, e.g., the quantity of drug, type of drug, order of dosage (which stack) and in which dispensing box 101, 102, 103 a stack of the dosage containers 200 is placed.

Examples of the order processing device 402 include dedicated processors to enact the description of the present disclosure, e.g., in a computing system; however other devices may also be used. The order processing device 402 may also include other computing devices, such as desktop computing devices, notebook computing devices, netbook computing devices, gaming devices, and the like. The device 402 may include a processor to execute dedicated instructions, a memory to store data and instructions, and communication functionality. Other types of electronic devices that can use rules and instructions to execute various functions may also be used.

Examples of the network 404 include Mobile Communications (GSM) network, a code division multiple access (CDMA) network, 3rd Generation Partnership Project (3GPP), an Internet Protocol (IP) network, a Wireless Application Protocol (WAP) network, a WiFi network, or an IEEE 802.11 standards network, as well as various combinations thereof. The network 404 may include optical communications. The network 404 may be a local area network or a global communication network, such as the Internet. Other conventional and/or later developed wired and wireless networks may also be used. In some embodiments, the network 404 may include a prescribing network such as the electronic prescribing network operated by Surescripts of Arlington, Va.

The benefit manager device 406 is a device operated by an entity at least partially responsible for creation and/or management of the pharmacy or drug benefit. While the benefit manager operating the benefit manager device 406 is typically a pharmacy benefit manager (PBM), other entities may operate the benefit manager device 406 either on behalf of themselves, the PBM, or another entity. For example, the benefit manager may be operated by a health plan, a retail pharmacy chain, a drug wholesaler, a data analytics or other type of software-related company, or the like. In some embodiments, a PBM that provides the pharmacy benefit may also provide one or more than one additional benefits including a health benefit, a dental benefit, a vision benefit, a wellness benefit, a radiology benefit, a pet care benefit, an insurance benefit, a long term care benefit, a nursing home benefit, and the like. The PBM may, in addition to its PBM operations, operate one or more than one pharmacy.

Some of the operations of the PBM that operates the benefit manager device 406 may include the following. A member (or a person on behalf of the member) of a pharmacy benefit plan administered by or through the PBM attempts to obtain a prescription drug at a retail pharmacy location where the member can obtain drugs in a physical store from a pharmacist or pharmacist technician, or in some instances through mail order drug delivery from a mail order pharmacy location. The member may also obtain a prescription drug directly or indirectly through the use of a machine, such as a kiosk, vending unit, mobile electronic device, or a different type of mechanical, electrical, an electronic communication device and/or computing device. The PBM may also operate to organize the drugs, the sachets 300, the drug dosage containers 200 and the drug boxes 101, 102, 103. The PBM may also select the color coding and indicia on the boxes 101, 102, 103 or on the dosage containers 200.

The member may have a co-pay for the prescription drug that reflects an amount of money that the member is responsible to pay the pharmacy for the prescription drug. The money paid by the member to the pharmacy may come from the personal funds of the member, a health savings account (HSA) of the member or the member's family, a health reimbursement arrangement (HRA) of the member or the member's family, a flexible spending accounts (FSA) of the member or the member's family, or the like. An employer of the member may directly or indirectly fund or reimburse the member or an account of the member for the co-pay.

The amount of the co-pay paid by the member may vary by the benefit plan of a plan sponsor or client with the PBM. The member's co-pay may be based on a flat co-pay (e.g., $10), co-insurance (e.g., 10%), and/or a deductible (e.g., for first $500 of annual prescription drug spend) for certain prescription drugs, certain types of prescription drugs, and/or all prescription drugs.

In certain instances, the member may not pay the co-pay or may only pay for a portion of a co-pay for a prescription drug. For example, if the usual and customary cost for a generic version of a prescription drug is $4, and the member's flat co-pay is $20 for the prescription drug, the member may only pay $4 to receive the prescription drug. In another example involving a worker's compensation claim, no co-pay may be due by the member for the prescription drug. The co-pay may also vary based on the channel used to receive the prescription drug. For example, the co-pay for receiving prescription drug from a mail order pharmacy location may be less than the co-pay for receiving prescription drug from a retail pharmacy location.

In conjunction with receiving the co-pay (if any) from the member and dispensing the prescription drug to the member, the pharmacy submits a claim to the PBM for the prescription drug. The PBM may perform certain adjudication operations including verifying the eligibility of the member, reviewing the formulary of the member to determine appropriate co-pay, coinsurance, and deductible for the prescription drug, and performing a drug utilization review (DUR) on the member. The PBM then provides a response to the pharmacy following performance of at least some of the aforementioned operations. As part of the adjudication, the plan sponsor (or the PBM on behalf of the plan sponsor) ultimately reimburses the pharmacy for filling the prescription drug when the prescription drug was successfully adjudicated. The aforementioned adjudication operations generally occur before the co-pay is received and the prescription drug dispensed. However, the operations may occur simultaneously, substantially simultaneously, or in a different order. In addition, more or less adjudication operations may be performed as at least part of the adjudication process.

The amount of reimbursement paid to the pharmacy by a plan sponsor and/or money paid by the member may be based at least in part on the type of pharmacy network in which the pharmacy is included. Other factors may be used to determine the amount in addition to the type of pharmacy network. For example, if the member pays the pharmacy for the prescription without using the prescription drug benefit provided by the benefit manager, the amount of money paid by the member may be higher and the amount of money received by the pharmacy for dispensing the prescription drug and for the prescription drug itself may be higher. Some or all of the foregoing operations may be performed by executing instructions on the benefit manager device 406 and/or an additional device.

In some embodiments, at least some of the functionality of the order processing device 402 may be included in the benefit manager device 406. The order processing device 402 may be in a client-server relationship with the benefit manager device 406, a peer-to-peer relationship with the benefit manager device 406, or in a different type of relationship with the benefit manager device 406.

The order processing device 402 and/or the benefit manager device 406 may be in communication directly (e.g., through local storage) and/or through the network 404 (e.g., in a cloud configuration or software as a service) with a database 408 (e.g., as may be retained in memory or otherwise). The database 408 may store order data 410, member data 412, claims data 414, drug data 416, prescription data 418, and/or plan sponsor data 420. Other data may be stored in the database 408. The order processing device 402 may operate to organize the drugs, the sachets 300, the drug dosage containers 200 and the drug boxes 101, 102, 103. The PBM may also select the color coding and indicia on the boxes 101, 102, 103 or on the dosage containers 200.

The order data 410 may include data related to the order of prescriptions including the type (e.g., drug name and strength) and quantity of each prescription in a prescription order, the prescription order may provide the time period and the dosages for each time the drug is to be taken by patient. The order data 410 may also include data used for completion of the prescription, such as prescription materials. In general, prescription materials are a type of order materials that include an electronic copy of information regarding the prescription drug for inclusion with or otherwise in conjunction with the fulfilled prescription. The prescription materials may include electronic information regarding drug interaction warnings, recommended usage, possible side effects, expiration date, date of prescribing, or the like. The order data 410 may be used by a high volume fulfillment center to fulfill a pharmacy order. The order data 410 may include the type of drug package 100. The order data 410 may include the indicia information 205 on a dosing container, the type of dosage container or box 101, 102, 103 to be included in the package 100, and whether the drug will be included in sachets 300. The order data 710 may further include color coding of the boxes 101, 102, 103 as well as associated labeling. In an example embodiment, the order 410 can be used to generate the color coding and information to be placed on the boxes 101, 102, 103 or elements of the drug package 100.

In some embodiments, the order data 410 includes verification information associated with fulfillment of the prescription in the pharmacy. For example, the order data 410 may include videos and/or images taken of (i) the prescription drug prior to dispensing, during dispensing, and/or after dispensing, (ii) the prescription container (e.g., a bag, a drug box, a prescription bottle and seal) used to contain the prescription drug prior to dispensing, during dispensing, and/or after dispensing, (iii) the packaging and/or packaging materials used to ship or otherwise deliver the prescription drug prior to dispensing, during dispensing, and/or after dispensing, and/or (iv) the fulfillment process within the pharmacy. Other type of verification information such as bar code data read from pallets used to transport prescriptions within the pharmacy may also be stored as order data 410.

The member data 412 includes information regarding the members associated with the benefit manager. Examples of the member data 412 include name, address, telephone number, e-mail address, prescription drug history, and the like. The member data 412 may include a plan sponsor identifier that identifies the plan sponsor associated with the member and/or a member identifier that identifies the member to the plan sponsor. The member data 412 may include a member identifier that identifies the plan sponsor associated with the patient and/or a patient identifier that identifies the patient to the plan sponsor. The member data 412 may also include, by way of example, dispensation preferences such as type of label, type of indicia, color coding, type of seal, message preferences, language preferences, or the like.

The member data 412 may be accessed by various devices in the pharmacy, e.g., the prescription drug fulfillment center, to obtain information utilized for fulfillment and shipping of prescription orders. In some embodiments, an external order processing device 402 operated by or on behalf of a member may have access to at least a portion of the member data 412 for review, verification, or other purposes.

In some embodiments, the member data 412 may include information for persons who are patients of the pharmacy but are not members in a benefit plan being provided by the benefit manager. For example, these patients may obtain drug directly from the pharmacy, through a private label service offered by the pharmacy, the high volume fulfillment center, or otherwise. In general, the use of the terms member and patient may be used interchangeably herein.

The claims data 414 includes information regarding pharmacy claims adjudicated by the PBM under a drug benefit program provided by the PBM for one, or more than one, plan sponsors. In general, the claims data 414 includes an identification of the client that sponsors the drug benefit program under which the claim is made, and/or the member that purchased the prescription drug giving rise to the claim, the prescription drug that was filled by the pharmacy (e.g., the national drug code number), the dispensing date, generic indicator, GPI number, medication class, the cost of the prescription drug provided under the drug benefit program, the copay/coinsurance amount, rebate information, and/or member eligibility. Additional information may be included.

In some embodiments, other types of claims beyond prescription drug claims may be stored in the claims data 414. For example, medical claims, dental claims, wellness claims, or other type of health care-related claims for members may be stored as a portion of the claims data 414.

In some embodiments, the claims data 414 includes claims that identify the members with whom the claims are associated. In some embodiments, the claims data 414 includes claims that have been de-identified (e.g., associated with a unique identifier but not with a particular, identifiable member).

The drug data 416 may include drug name (e.g., technical name and/or common name), other names by which the drug is known by, active ingredients, an image of the drug (e.g., in pill form), and the like. The drug data 416 may include information associated with a single medication or multiple medications. The drug data may be used to determine which drugs are placed into each drug container to provide the drug treatment regime with the correct dosage at the correct time.

The prescription data 418 may include information regarding prescriptions that may be issued by prescribers on behalf of patients, who may be members of the drug benefit plan, for example to be filled by a pharmacy. Examples of the prescription data 418 include patient names, medication or treatment (such as lab tests), dosing information, and the like. The prescriptions may be electronic prescriptions, paper prescriptions that have been scanned, or otherwise. In some embodiments, the dosing information reflects a frequency of use (e.g., once a day, twice a day, before each meal, etc.) and a duration of use (e.g., a few days, a week, a few weeks, a month, etc.).

In some embodiments, the order data 410 may be linked to associated member data 412, claims data 414, drug data 416, and/or prescription data 418.

The plan sponsor data 420 includes information regarding the plan sponsors of the benefit manager. Examples of the plan sponsor data 420 include company name, company address, contact name, contact telephone number, contact e-mail address, and the like.

The order processing device 402 may direct at least some of the operations of devices 422-444, recited above. In some embodiments, operations performed by one of these devices 422-444 may be performed sequentially, or in parallel with the operations of another device as may be coordinated by the order processing device 402. In some embodiments, the order processing device 402 tracks a prescription with the pharmacy based on operations performed by one or more of the devices 422-444.

In some embodiments, the system 400 may transport prescription drug containers (e.g., between one or more than one of the devices 422-444 in the high volume fulfillment center) by use of pallets. The pallet sizing and pucking device 422 may configure pucks in a pallet. A pallet may be a transport structure for a number of prescription containers, and may include a number of cavities. A puck may be placed in one or more than one of the cavities in a pallet by the pallet sizing and pucking device 422. A puck may include a receptacle sized and shaped to receive a prescription container, e.g., a dispensing container, dispensing boxes or the like. Such containers may be supported by the pucks during carriage in the pallet. Different pucks may have differently sized and shaped receptacles to accommodate containers of differing sizes, as may be appropriate for different prescriptions. The pucks can be adapted to hold sachets 300, dosing packages 200 or pages of dosing packages.

The arrangement of pucks in a pallet may be determined by the order processing device 402 based on prescriptions which the order processing device 402 decides to launch. In general, prescription orders in the order database 410 reside in one or more than one queues, and are generally launched in a first-in-first-out order. However, the order processing device 402 may use logic and a variety of factors to determine when and how prescriptions are to be launched. For example, some non-limiting factors which may alter the first-in-first-out order of launching prescriptions in a pharmacy include the age of the order, whether the order required an outreach to a physician or some other intervention, whether there are any performance guarantees with plan sponsors or members, the available inventory of a given pharmaceutical in view of existing prescriptions already launched which will require that pharmaceutical, the zip code to which the order will be shipped, the workload and volume of various parts of the pharmacy, whether valid paperwork for the order has been received, and/or similar orders for the same pharmaceutical that are already to be launched. The logic may further be restricted on what pharmacy has the ability to fill a drug package 100 that is needed for such a complex drug treatment regimen. The logic may be implemented directly in the pallet sizing and pucking device 422, in the order processing device 402, in both devices 402, 422, or otherwise. Once a prescription is set to be launched, a puck suitable for the appropriate size of container (e.g., drug boxes 100, dosage containers 200, or sachets 300) for that prescription may be positioned in a pallet by a robotic arm or pickers. The pallet sizing and pucking device 422 may launch a pallet once pucks have been configured in the pallet. It will be understood that a puck operation may not be required to fill this prescription in all cases. In an example, the separate machines that are distinct from the pallet and pucking systems may be used.

The loading device 424 may load prescription containers, e.g., drug boxes 100, dosage containers 200, sachets 300, into the pucks on a pallet by a robotic arm, pick and place mechanism, or the like. In one embodiment, the loading device 408 has robotic arms or pickers to grasp a prescription container and move it to and from a pallet or a puck. The loading device 424 may also print a label which is appropriate for a container that is to be loaded onto the pallet, and apply the label to the container, e.g., drug boxes 100, dosage containers 200, sachets 300. The pallet may be located on a conveyor assembly during these operations, e.g., at the high volume fulfillment center. The loading device 424 may place individual drug containers or stacks of containers in the dispensing boxes 101, 102, 103. The loading device 424 may include a gripper on the arm that can load and hold a stack of drug containers.

The inspect device 426 may verify that drug containers or dispensing boxes in a pallet are correctly labeled and in the correct spot on the pallet. The inspect device 426 may scan the label on one or more than one container on the pallet. Labels of containers may be scanned or imaged in full or in part by the inspect device 426. Such imaging may occur after the container has been lifted out of its puck by a robotic arm, picker, or the like, or may be otherwise scanned or imaged while retained in the puck. In some embodiments, images and/or video captured by the inspect device 426 may be stored in the database 408 as order data 410. The inspect device 426 may image the dispensing boxes to see through the window to confirm that the dispensing boxes are filled to an appropriate level per the prescription. The inspect device 426 can inspect any of the drug boxes 100, the dosage containers 200, and the sachets 300, to conform the proper filling of the prescription order.

The unit of use device 428 may temporarily store, monitor, label and/or dispense unit of use products. In general, unit of use products are prescription drug products that may be delivered to a patient or member without being repackaged at the pharmacy. These products may include pills in a container, pills in a blister pack, inhalers, and the like. Prescription drug products dispensed by the unit of use device 428 may be packaged individually or collectively for shipping, or may be shipped in combination with other prescription drugs dispenses by other devices in the high volume fulfillment center. The unit of use device 428 may include pre-packaged drug packages 100 or dosage containers 200 to be included in a drug package 100 or in a drug box 101, 102, 103. In some instances, a drug regimen is ordered frequently enough in a drug package 100 such that the particular dosage container 200, box 101, 102, 103 or package itself is pre-assembled as a unit of use structure. Such a pre-assembled structure may be dispensed by the unit-of-use device 428.

The drug boxes 101, 102, 103 may be dispensed from the unit-of-use device 428 or could be filled at the manual fulfillment device 432 depending on drug type, regimen complexity, standard regimen v. custom regimen, and so on. A standard regimen may be a box that is fulfilled by the unit-of-use device 428.

The automated dispensing device 430 may include one or more than one devices that dispense prescription drugs or pharmaceuticals into prescription drug containers in accordance with one or multiple prescription orders, e.g., an order that includes a complex treatment regimen. In general, the automated dispensing device 430 may include mechanical and electronic components with, in some embodiments, software and/or logic to facilitate pharmaceutical dispensing that may otherwise be performed in a manual fashion by a pharmacist and/or pharmacist technician. For example, the automated dispensing device 430 may include high volume fillers that fill a number of prescription drug types at a rapid rate and blister pack machines that dispense and pack drugs into a blister pack. Prescription drugs dispensed by the automated dispensing devices 430 may be packaged individually or collectively for shipping, or may be shipped in combination with other prescription drugs dispenses by other devices in the high volume fulfillment center. The prescription drugs may be placed in the drug containers 200.

The manual fulfillment device 432 may provide for manually fulfillment of prescriptions. For example, the manual fulfillment device 432 may receive or obtain a container, e.g., a drug box 101, 102, 103 or a dosage container 200 and enable fulfillment of the container by a pharmacist or pharmacy technician. In some embodiments, the manual fulfillment device 432 provides the filled container to another device in the system 400 to be joined with other containers in a prescription order for a patient or member. In general, a manual fulfillment may include operations at least partially performed by a pharmacist or pharmacy technician. For example, a person may retrieve a supply of the prescribed drug, may make an observation, may count out a prescribed quantity of drugs and place them into a prescription container, or the like. Some portions of the manual fulfillment process may be automated by use of a machine. For example, counting of capsules, tablets, or pills may be at least partially automated (e.g., through use of a pill counter). Prescription drugs dispensed by the manual fulfillment device 432 may be packaged individually or collectively for shipping, or may be shipped in combination with other prescription drugs dispenses by other devices in the high volume fulfillment center. In some instances, the drug boxes 101, 102, 103 may be assembled and filled at the manual fulfillment device 432. The manual fulfillment device 432 may also be used to package sachets 300 or dosage containers 200 and fill the drug boxes with the dosage containers 200

The review device 434 may process prescription containers, e.g., drug boxes 100, dosage containers 200 sachets 300, to be reviewed by a pharmacist for proper pill count, exception handling, prescription verification, and the like. Fulfilled prescriptions may be manually reviewed and/or verified by a pharmacist, as may be required by state or local law. A pharmacist or other licensed pharmacy person who may dispense certain drugs in dispensing with local and/or other laws may operate the review device 434 and visually inspect a prescription container that has been filled with a prescription drug. The pharmacist may review, verify, and/or evaluate drug quantity, drug strength, and/or drug interaction concerns, or otherwise perform pharmacist services. The pharmacist may also handle containers which have been flagged as an exception, such as containers with unreadable labels, containers for which the associated prescription order has been cancelled, containers with defects, and the like.

The imaging device 436 may image containers, e.g., drug boxes 100, dosage containers 200 sachets 300, once they have been filled with pharmaceuticals. The imaging device 436 may measure the fill height of the pharmaceuticals in the container based on the obtained image to determine if the container is filled to the correct height given the type of pharmaceutical and the number of pills in the prescription. Images of the pills in the container may also be obtained to detect the size of the pills themselves and markings thereon. The images may be transmitted to the order processing device 402, and/or stored in the database 410 as part of the order data 410.

The sealing device 438 may be used to cap or otherwise seal a prescription container, e.g., drug boxes 100, dosage containers 200 sachets 300. In some embodiments, the sealing device 438 may secure a prescription container with a type of seal in accordance with a patient preference (e.g., a preference regarding child resistance), a plan sponsor preference, a prescriber preference, or the like. The sealing device 438 may also label a message into the outside of the drug container or dispensing box, although this process may be performed by a subsequent device in the high volume fulfillment center.

The accumulation device 440 accumulates various containers of prescription drugs in a prescription order. The accumulation device 440 may accumulate prescription containers from various devices or areas of the pharmacy. For example, the accumulation device 440 may accumulate prescription containers from the unit of use device 428, the automated dispensing device 430, the manual fulfillment device 432, and the review device 434, at the high volume fulfillment center. The accumulation device 440 may be used to group the prescription containers, e.g., the dispensing boxes which are filled with drug containers, prior to shipment to the member or otherwise.

The packing device 442 packages a prescription order in preparation for shipping the order. The packing device 442 may box, bag, or otherwise package the fulfilled prescription order for delivery. The packing device 442 may further place inserts into the packaging. For example, bulk prescription orders may be shipped in a shipping box, while other prescription orders may be shipped in a bag which may be a wrap seal bag. The packing device 442 may label the box or bag with the address and a recipient's name. The packing device 442 may sort the box or bag for mailing in an efficient manner (e.g., sort by delivery address). The packing device 442 may include ice or temperature sensitive elements for prescriptions which are to be kept within a temperature range during shipping in order to retain efficacy or otherwise. The ultimate package may then be shipped through postal mail, through a mail order delivery service that ships via group and/or air (e.g., UPS, FedEx, or DHL), through delivery service, through a locker box at a shipping site (e.g., Amazon locker or a PO Box), or otherwise.

The unit of use packing device 444 packages a unit of use prescription order in preparation for shipping the order. The unit of use packing device 444 may include manual scanning of containers to be bagged for shipping to verify each container in the order.

While the system 400 in FIG. 4 is shown to include single devices 402, 406, 422-444 multiple devices may be used. The devices 402, 406, 422-444 may be the same type or model of device or may be different device types or models. When multiple devices are present, the multiple devices may be of the same device type or models or may be a different device type or model. The types of devices 402, 406, 422-444 shown in FIG. 4 are example devices. In other configurations of the system 400, lesser, additional, or different types of devices may be included.

Moreover, the system 400 shows a single network 404; however, multiple networks can be used. The multiple networks may communicate in series with each other to link the devices 402, 406, 422-444 or in parallel to link the devices 402, 406, 422-444. Multiple devices may share processing and/or memory resources. The devices 402, 406, 422-444 may be located in the same area or in different locations. For example, the devices 402, 406, 422-444 may be located in a building or set of adjoining buildings. The devices 402, 406, 422-444 may be interconnected (e.g. by conveyors), networked, and/or otherwise in contact with one another or integrated with one another, e.g., at the high volume fulfillment center. In addition, the functionality of a device may be split among a number of discrete devices and/or combined with other devices.

In use, the system 400 may be used to fill the individual dispensing boxes 101, 102, 103 with drug containers storing drugs as prescribed for a patient to take a drug regimen. Individual drug, e.g., pills and the like, may be delivered to a manual fill station and inserted in sachets 300 or directly into dosage containers 200. The dosage containers 200 are appropriately labeled at location 205. If sachets 300 are used, then the individual sachets 300 are also labeled. Then the dosage containers 200 are loaded into the appropriate dosage box 101, 102 or 103 with the first dosage containers to be taken being at the bottom of the drug container and the last at the top of the drug box 101, 102, 103. The drug box 101, 102, 103 may then be sealed. All of the drug boxes 101, 102, 103 associated with a prescription are filled before packaging for shipment to a patient.

Figure 5A:
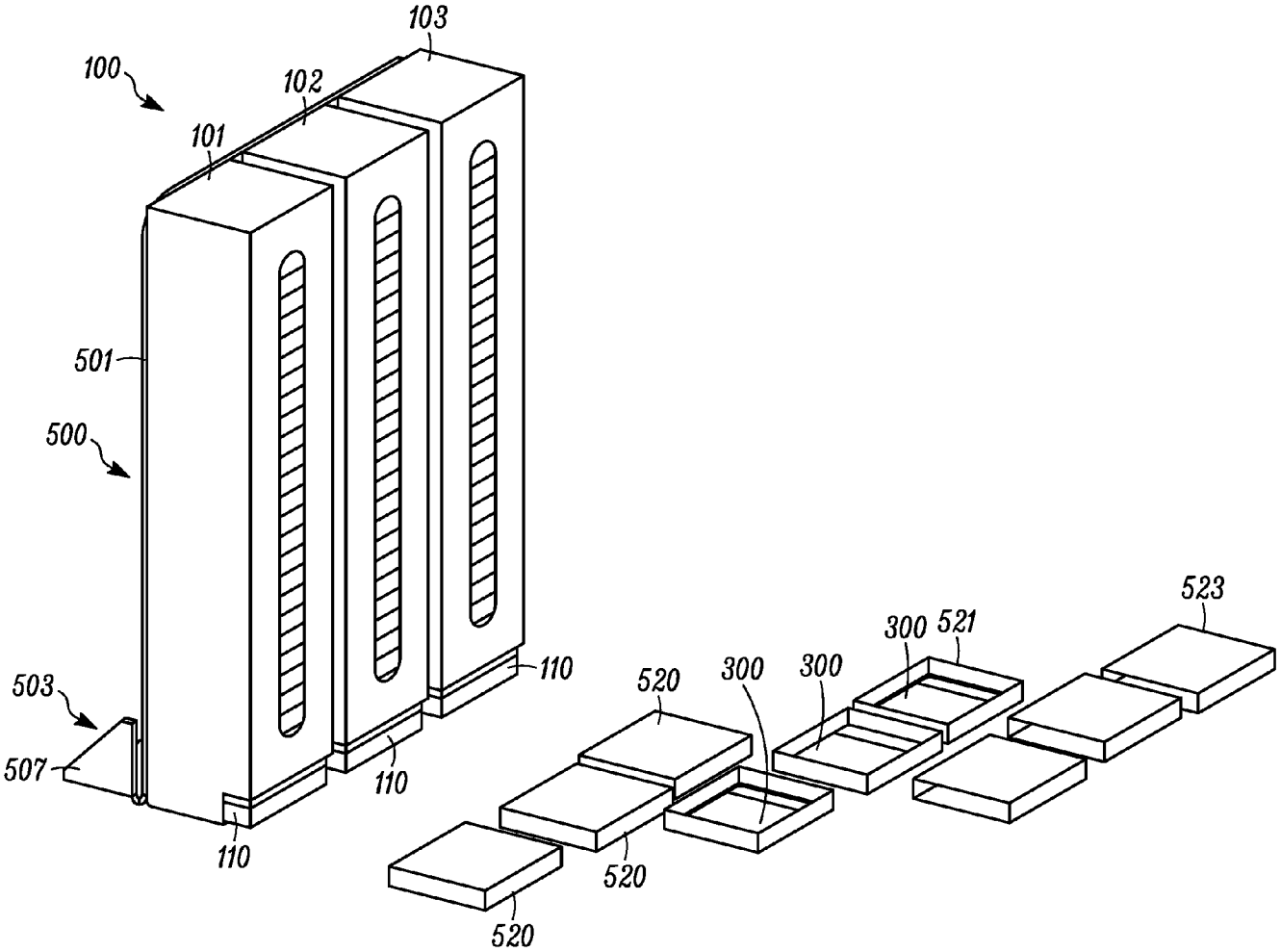
FIG. 5A shows a first side, front perspective view of a medication dispensing device, according to an example embodiment.

FIG. 5A is a view of a drug package 100, according to an example embodiment. The drug package 100 includes one drug box or multiple drug boxes 101, 102, 103 as described herein along with a supporting frame 500. While three drug boxes 101, 102, 103 are shown in FIG. 1, other configurations including different number of drug boxes may be provided (e.g., based on dosing times during the day), e.g., 2, 4, or more boxes. The drug boxes 101, 102, 103 may include any of the features as recited herein.

The supporting frame 500 includes a backing 501 that is adapted to support the drug boxes 101, 102, 103 from behind, e.g., with the rear surface of the drug boxes being against or near a surface of the backing 501. The backing 501 may be a plate with height and width dimensions significantly greater than its depth. In an example, the height of the backing 501 is about equal to the height of the boxes 101, 102, 103. In another example, the backing 501 is less than the height of the boxes, e.g., greater than one-quarter the height of the drug boxes 101, 102, 103, less than 90% of the height of the drug boxes or about half the height of the drug boxes, or ranges therebetween. The width of the backing 501 is about equal to or slightly greater than the width of the number of drug boxes 101, 102, 103 that will be supported in the supporting frame 500. In an example, the width of the backing 500 is such that it at least partially extends behind all of the drug boxes 101, 102, 103 being supporting by the frame 500. As illustrated, the backing 501 is about as wide as three drug boxes as there are three drug boxes shown in the illustrated embodiment. The backing 501 may be a solid material, such as a metal or a polymer. The backing 501 is not limited to a solid plate and may include structures with apertures therein, e.g., a screen. Adhesive devices may be included on the backing 501 that interact with the boxes 101, 102, 103 to secure the boxes to the backing, e.g., a hook and loop fastener part with the mating part on the back surface of the boxes 101, 102, 103.

Figure 5B:
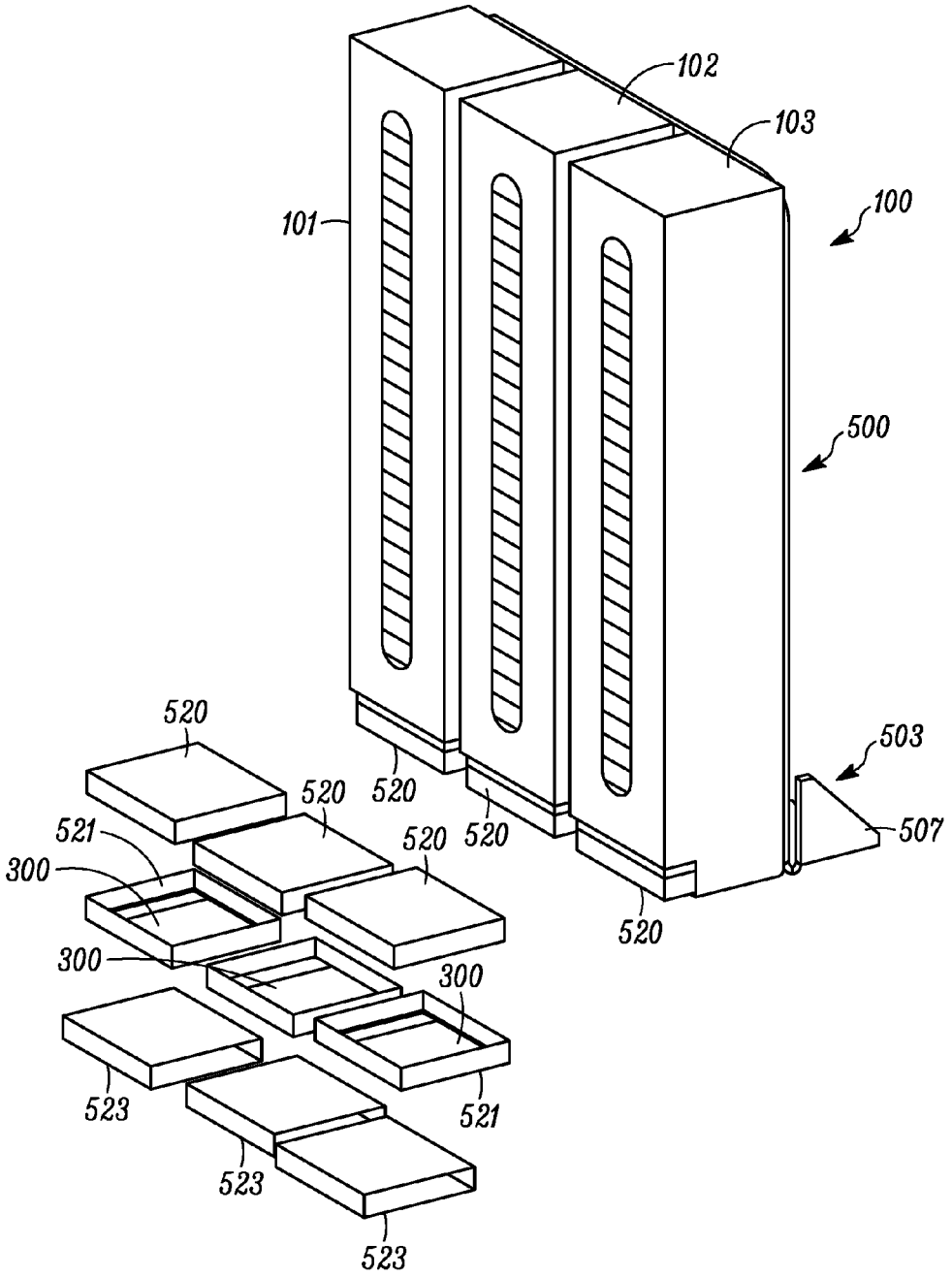
FIG. 5B shows a second side, front perspective view of a medication dispensing device, according to an example embodiment.
Figure 6:
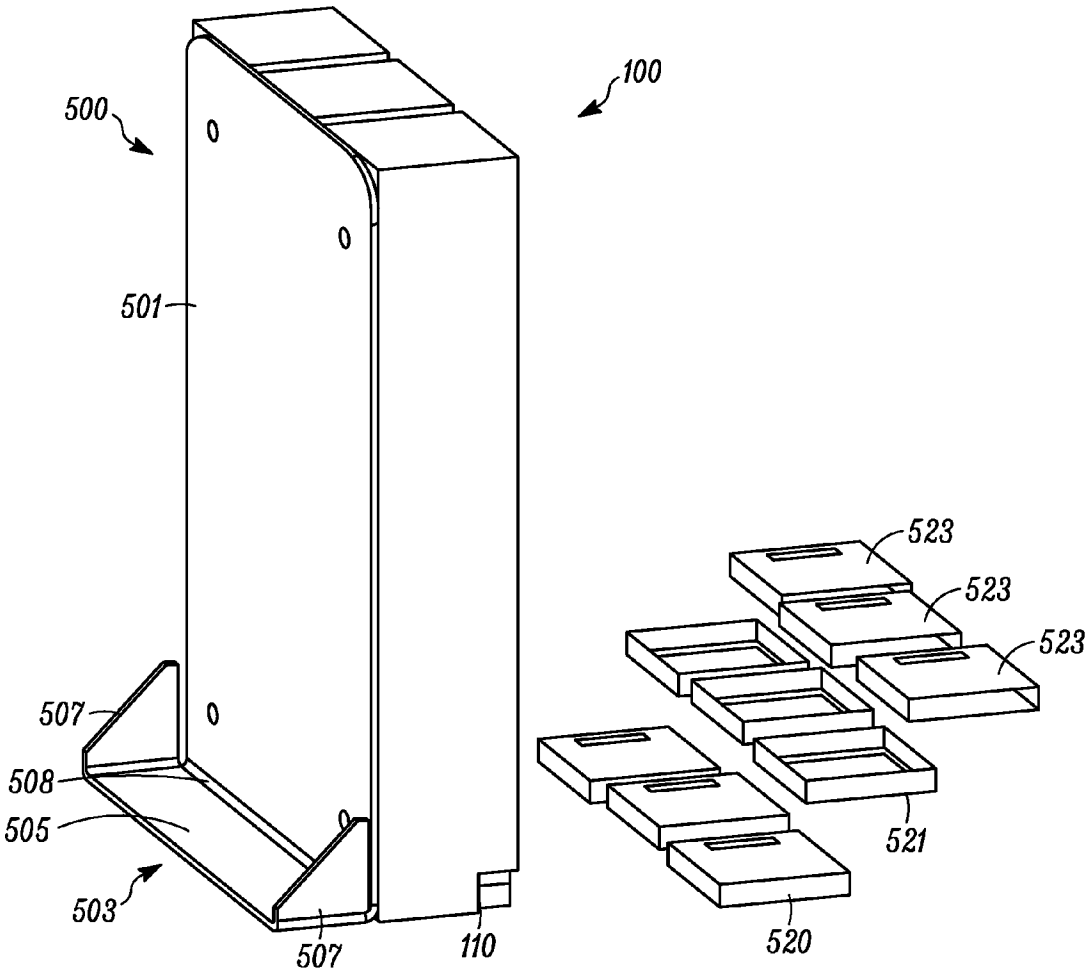
FIG. 6 shows a first side, rear perspective view of a medication dispensing device, according to an example embodiment.

A supporting foot assembly 503 is positioned at the bottom end of the backing 501. The supporting foot assembly 503 is configured to hold the boxes in a vertical orientation for dispensing. The supporting foot assembly 503 extends away from the backing 501, e.g., rearwardly from the backing 501. The supporting foot assembly 503 includes a foot 505 and side walls 507 positioned at each end of the foot 505. The foot 505 can be a plate that extends the width of the backing 501. The foot 505 may be a solid material, such as a metal or a polymer. The foot 505 is not limited to a solid plate and may include structures with apertures therein, e.g., a screen. The foot 505 may include adhesive devices that assist in securing the drug package 100 to a horizontal surface, e.g., a table top, a counter top and the like. Adhesive devices include, but are not limited to, hook and loop fasteners parts with the other part on the horizontal surface, glues, removable adhesives (e.g., those marketed by the 3M Company of St. Paul, Minn.) and the like. As shown in FIGS. 5A, 5B and 6, the foot extends reward from the backing 501 and the dispensing aperture 110 of a box 101, 102, 103 in the dispensing position.

Side walls 507 are positioned at the lateral side ends of the foot 505, which can be elongate, and extend in a different direction relative to the foot 505. A wall 507 extends at generally a right angle relative to the foot 505. The side walls 507 are positioned outside the drug boxes 101, 102, 103 such that when the foot 501 is folded along a crease 508 (FIG. 6) so that the foot 505 is at an angle with a bottom of the drug boxes 101, 102, 103, then the side walls 507 can be positioned at least partly adjacent an outer side surface of a respective drug box, here, boxes 101 and 103.

The foot assembly 500 operates to hold the drug boxes 101, 102, 103 in a vertical orientation with the drug package 100 being on a horizontal surface.

FIGS. 5A, 5B and 6 also show alternative embodiments for a drug box conveying the proper drug dosage to patient. A dosage box 520 is shown and operates similarly to the dosage containers 200 described herein, e.g., both have the ability to hold one or multiple drugs and/or one or multiple sachets 300 containing a single drug or multiple drugs therein. The dosage box 520 stores an individual drug dose associated with a particular date and time for taking the drug as described herein. The dosage box 520 includes an inner tray 521, which may be a box with an open top, and an outer casing or cover 523, which may be a box with an open end or open ends. The outer casing 523 slidably receives the inner tray 521 in which the sachets 300 or drugs are stored. The sachets, e.g., the drug dose, is not accessible until the open top of the inner tray 521 is past the outer casing 523 by sliding the tray 521 out the open end of the outer casing 523. In the illustrated embodiments, two dosage boxes 520 are removed from each of the drug boxes 101, 102, 103, with one being shown in the assembly state and the other being shown in the separated state. The dosages boxes 520 can be coded to match their respective drug box 101, 102, 103, e.g., color coded, time coded or include other indicia that matches the respective drug box. The dosage boxes 520 may be tracked using bar codes, QR codes, 2D codes, other machine readable codes and the like.

Figure 7:
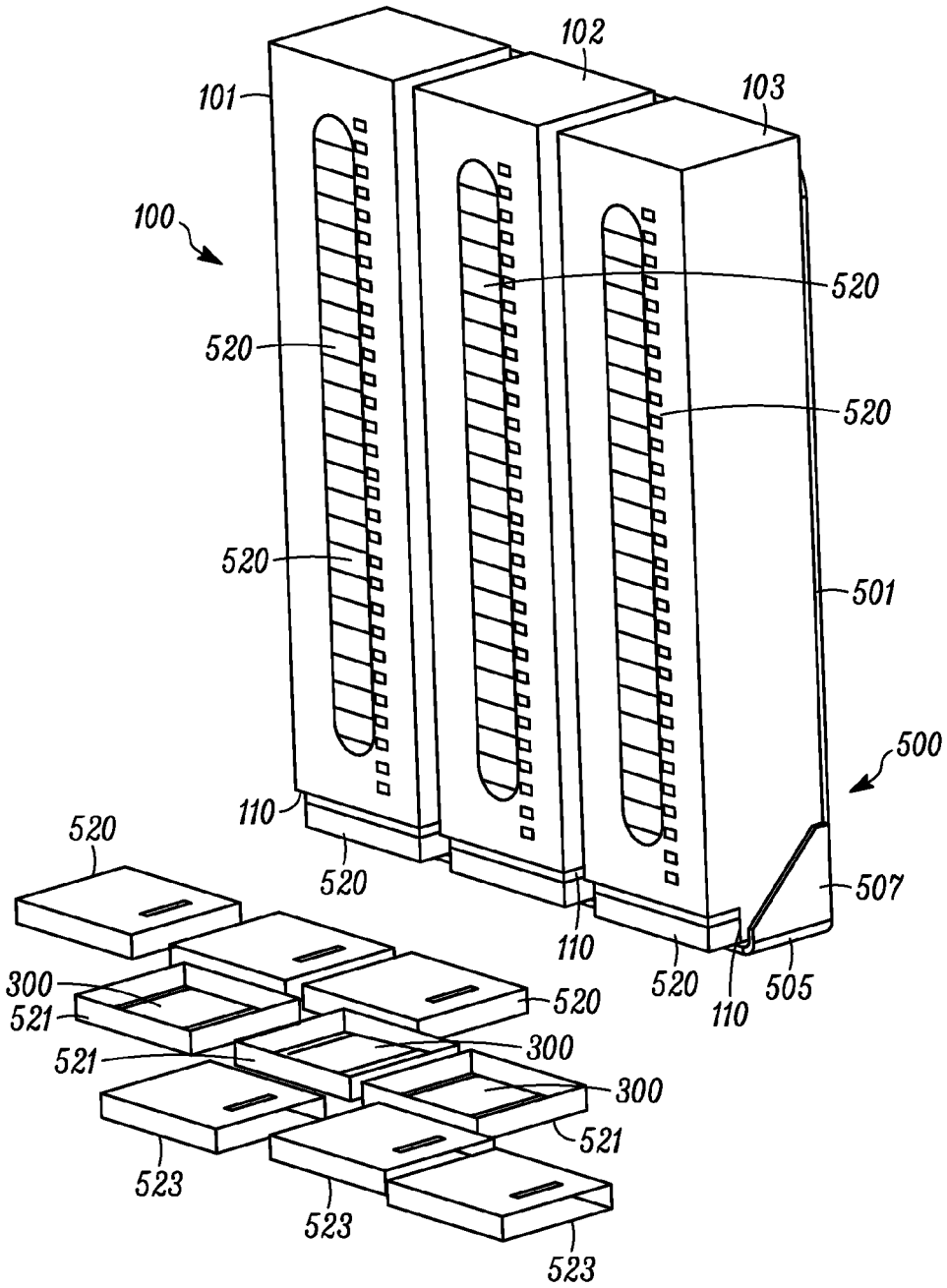
FIG. 7 shows a front perspective view of a medication dispensing device, according to an example embodiment.
Figure 8A:
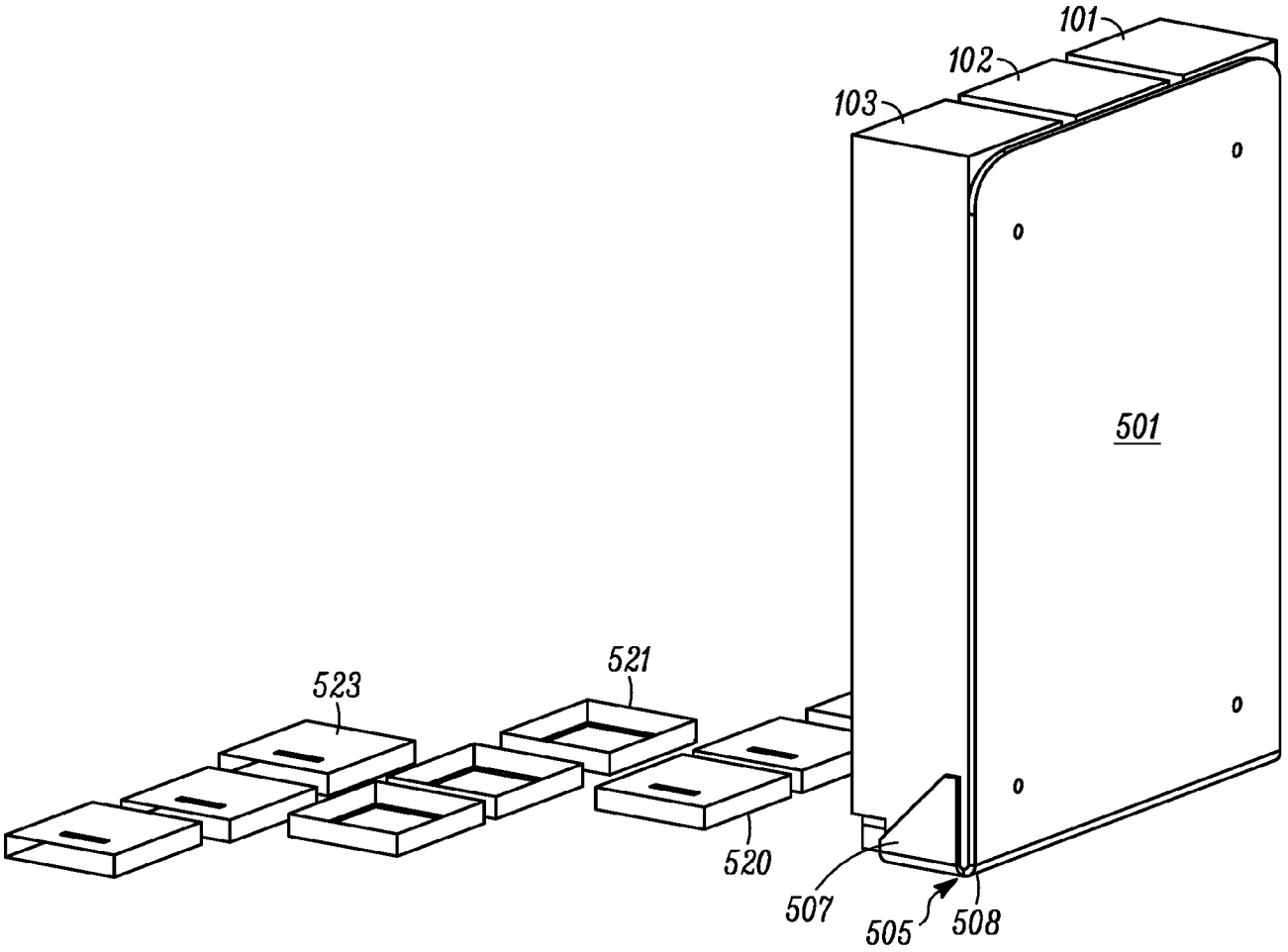
FIG. 8A shows a first side, rear perspective view of a medication dispensing device, according to an example embodiment.
Figure 8B:
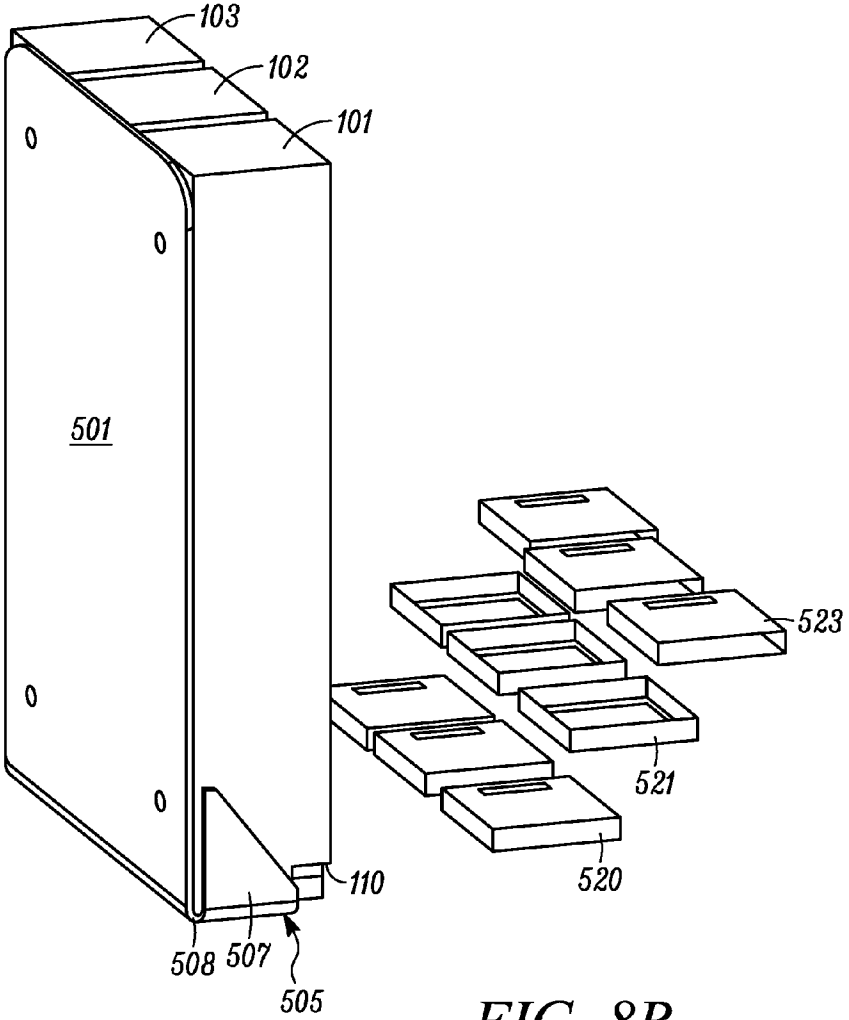
FIG. 8B shows a second side, rear perspective view of a medication dispensing device, according to an example embodiment.

FIGS. 7, 8A and 8B show the drug package 100 with the foot assembly 500 in an alternate position, e.g., rotated 180 degrees with reference to FIGS. 5A, 5B and 6. Here the side walls 507 are positioned adjacent the outer side of drug box 101 and outer side of drug box 103.

The drug package 100 may be assembled by first inserting the appropriate drug or drugs into the sachets 300. The sachets 300 are placed in the appropriate inner tray 521. In an example, both the sachets 300 and the inner tray include identifying indicia that allow the drug to be tracked. In an example, all of the inner trays 521 for a single drug box 101, 102 or 103 are loaded with the appropriate drug and dosage amount. These can all be visually inspected by a person, machine vision devices, or both. Once this has been confirmed, then the inner trays 521 can be placed in the outer casings 523. The outer casing 523 may have individual indicia that uniquely identify a particular dosage box 520. All of the dosage boxes 520 for an individual drug box 101, 102, 103 are stacked. The dosage box stack may be slid into an open top or open bottom of the drug box and then the opening is sealed. In some embodiments, the dosage box stack is slid into an open side of the drug box, e.g., all of the dosage boxes in the stack enter the drug box at essentially the same time. Then, the side of the drug box 101, 102, 103 is sealed.

Figure 9:
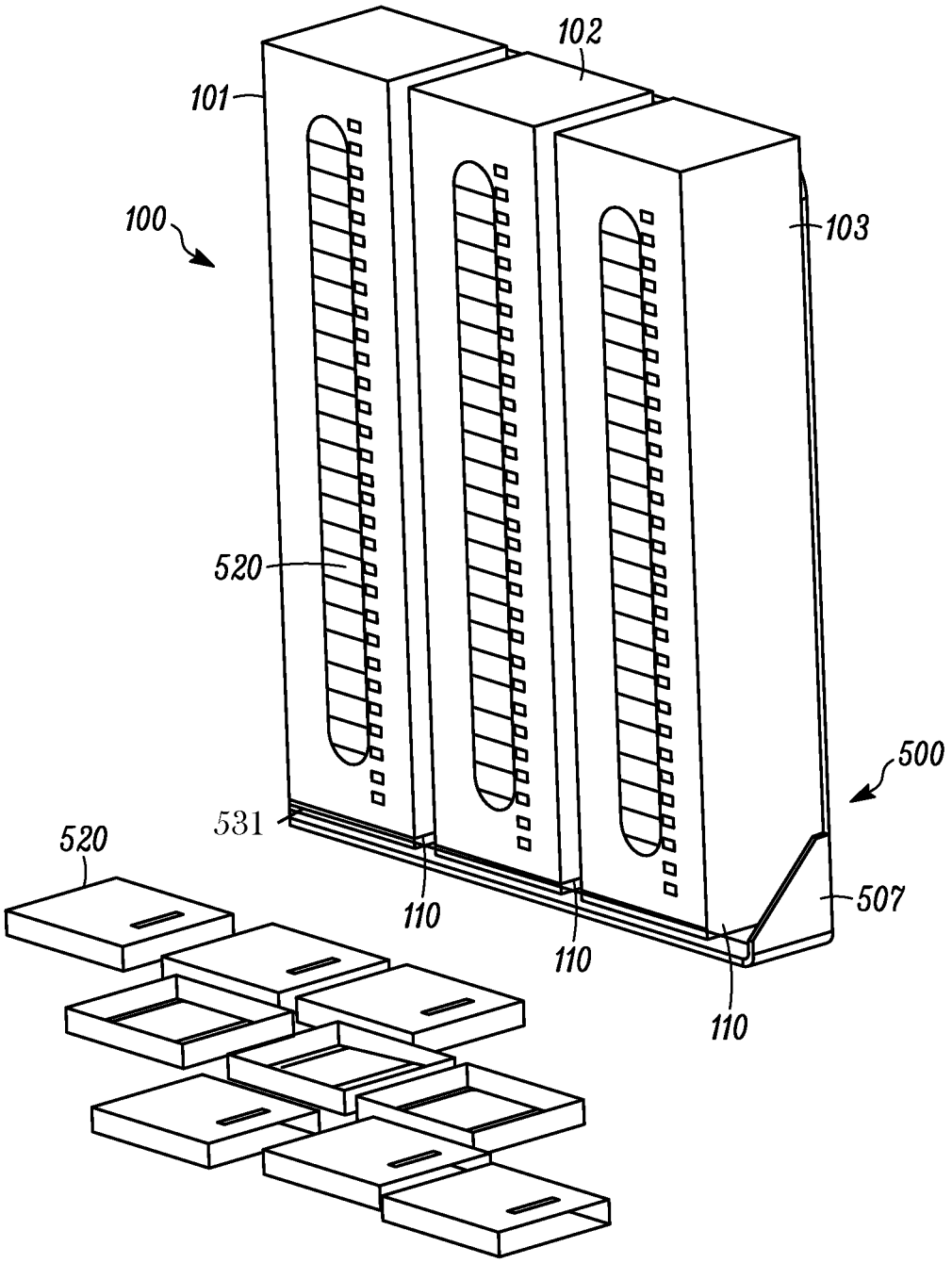
FIG. 9 shows a front perspective view of a medication dispensing device, according to an example embodiment.

FIG. 9 shows another example embodiment of the foot assembly 503, which is the same as that previously described but with a front closure 531 that extends around the front of the drug boxes 101, 102, 103 to at least partially close the dispensing aperture 110. The front closure 531 operates to hold the dosage boxes 520 in the drug boxes 101, 102, 103, e.g., during transport to the patient. The front closure 531 may be removed from the remainder of the foot assembly 503 when the foot assembly 503 is pivoted behind the backing 501 relative drug boxes, e.g., as shown in FIG. 5A. In some embodiments, the foot 505 may not rest on the horizontal surface but may be at angle thereto with the front closure 531 resting on the horizontal surface.

Figure 10:
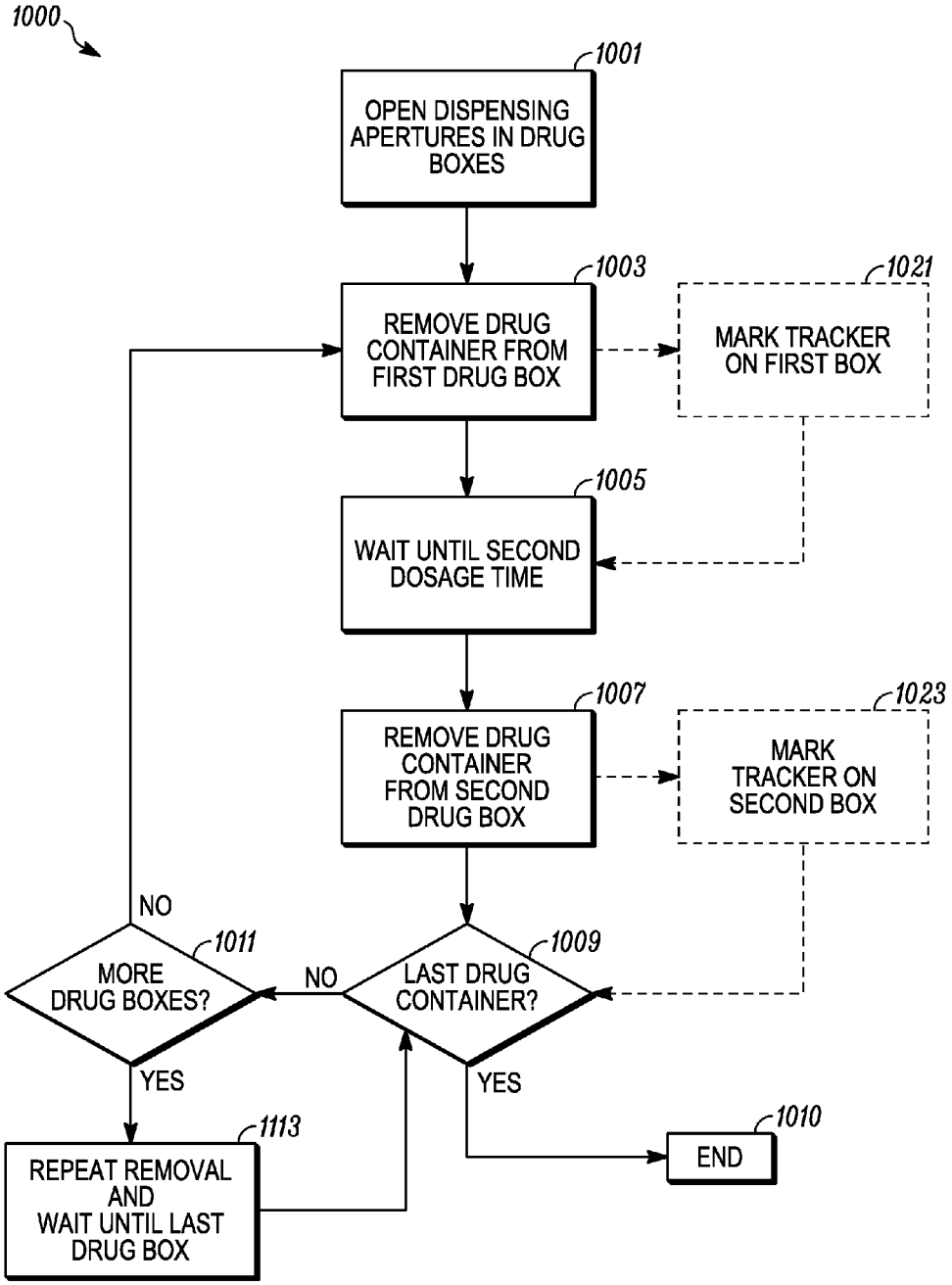
FIG. 10 shows a flowchart of a method, according to an example embodiment.

FIG. 10 shows an example method 1000 that can be practiced using the drug packaging 100 as described herein. At block 1001, the drug boxes are opened such that the dispensing apertures provide access to the drug containers in the drug boxes. If there is a protective wrap on the drug boxes, it is removed.

At block 1003, the first drug container in the first drug box is removed. The patient takes the contents in the first drug container.

At block 1005, a time period passes to the subsequent or second dosage time. This time period is the time between doses.

At block 1007, the first drug container from the second drug box is removed. The patient takes the contents in this drug container.

At decision point 1009, a determination is made as to whether the most recent drug container was the last drug container in any of the drug boxes. If yes, then the method ends at 1010. The end 1010 may ultimately cause a patient to see their medical care provider and request a refill or update on the treatment regimen. If no, the method moves to decision point 1011 to determine if there are additional drug boxes.

If "yes" at decision point 1011, then the method 1000 moves to repeats the removal from that drug box and waiting steps at block 1113 until a last drug box, which can be determined by returning to block 1009. If operations performed at blocks 1009 and 1011 both result in a "no" result, then the method 1000 returns to block 1003.

In some embodiments, operations may be performed at blocks 1021 and 1023. When a drug container is removed from the drug box, then that respective drug box is marked when the items, e.g., drugs or placebos, are taken by the patient.

The configuration of the drug boxes, 101, 102, 103 may decrease the likelihood that a patient takes a prescription drug dosing out of order and/or at the wrong time of the day.

The inventive subject matter may be represented in a variety of different embodiments of which there are many possible permutations.

While the methods and systems described herein generally reflect the distribution of prescription drugs, other materials may be so packaged. Examples of other materials include vitamins, over the counter drugs, marijuana, candy, and the like.

Thus, methods and structures for medication delivery have been described. Although embodiments of the present invention have been described with reference to specific example embodiments, it will be evident that various modifications and changes may be made to these embodiments without departing from the broader spirit and scope of the embodiments of the invention. Accordingly, the specification and drawings are to be regarded in an illustrative rather than a restrictive sense.

The methods described herein do not have to be executed in the order described, or in any particular order. Moreover, various activities described with respect to the methods identified herein can be executed in serial or parallel fashion.

We claim:

1. A medication dispensing device, comprising:

a plurality of dosage containers including a first dosage container and a second dosage container each configured for storing at least one sachet containing at least one pharmaceutical dose, the plurality of dosage containers being positioned based on an order of treatment, a first sachet of the at least one sachet of the first dosage container storing a first pharmaceutical dose that is different from a second pharmaceutical dose stored in a second sachet of the at least one sachet of the second dosage container, wherein a dosage container of the plurality of dosage containers includes a transparent medication storing bag enclosing the at least one sachet with a drug information area of the sachet visible through the medication storing bag, the medication storing bag being a single treatment for a drug regimen and configured to enclose all of the sachets for the single treatment;

at least one box including a plurality of box walls defining an interior that extends vertically and is configured to store the plurality of dosage containers in the ordered position; wherein the plurality of box walls includes:

a front wall of the plurality of box walls including (a) a level indicator to view a remaining amount of dosage containers in the interior of the box and a removed amount of the dosage containers from the box or both, and (b) a dose tracker to allow a user to indicate the drugs taken; and a dispensing aperture located in at least one of the plurality of box walls to allow a next dosage container of the plurality of dosage containers to be removed from the interior of the at least one box.

2. The medication dispensing device of claim 1, wherein the plurality of dosage containers includes at least one placebo dosage container that does not have a pharmaceutical active ingredient to treat a patient with the placebo dosage container having the same number of sachets and placebo pills in the sachets as a non-placebo dosage container.

3. The medication dispensing device of claim 1, wherein the at least one sachet stores a pharmaceutical dose that is based on weight of a patient.

4. The medication dispensing device of claim 1, wherein the plurality of dosage containers are positioned in a horizontal orientation with indicia on each of the plurality dosage containers facing upwardly and the plurality of dosage containers are vertically stacked one on top of the other.

5. The medication dispensing device of claim 1, wherein the dose tracker includes a check box that can be marked to indicate that an associated pharmaceutical dose has been taken.

6. The medication dispensing device of claim 1, wherein the at least one sachet stores a first number of pills for a first patient, wherein the first number is greater than a second number of pills required for a second patient who has a weight that is lighter than a weight of the first patient.

7. The medication dispensing device of claim 1, wherein the dispensing aperture is sized to allow a single one of the plurality of dosage containers to be removed from the interior of the at least one box at a time.

8. The medication dispensing device of claim 7, wherein the dispensing aperture is positioned adjacent a bottom of the at least one box with the next dosage container for supply a treatment to a patient at the dispensing aperture, the next dosage container being associated with a topmost indicator at the level indicator and an upper one indicator of the dose tracker that has not yet been tracked.

9. The medication dispensing device of claim 7, wherein a dosage container of the plurality of dosage containers is a dosage box sized such that a single dosage box is removed through the aperture at one time.

10. The medication dispensing device of claim 7, wherein the dispensing aperture is sized so that one dosage container is visible or accessible from outside the at least one drug box.

11. The medication dispensing device of claim 7, wherein a dosage container of the plurality of dosage containers includes a tray with an opening and an outer casing to removably close the opening in the tray such that medication in the tray is enclosed until after the outer casing is removed from the tray by longitudinally freely sliding the outer casing off the tray, and wherein the medication storing bag is stored in the tray.

12. The medication dispensing device of claim 11, wherein the outer casing is slidable on the tray through an aperture in the outer casing with the aperture being transverse to the opening in the tray and a construction of the outer casing and the tray is sized to allow a single assembly of one tray and one outer casing to be removed through the dispensing aperture at one time with all of the assemblies of the one tray and one outer casing exiting through the sole one of the dispensing aperture in the box.

13. The medication dispensing device of claim 7, wherein each of the at least one box is associated with each time period in a day that a drug is taken, wherein each of the plurality of dosage containers in a respective box of the at least one box contains an item to be taken at a same time each day, and wherein the item is the pharmaceutical dose or a placebo.

14. A medication dispensing system, comprising:

a plurality of dosage containers storing a transparent medication bag enclosing therein at least one sachet containing at least one medication, each of the plurality of dosage containers including drugs needed for a single dose at a particular time according to a drug treatment regime;

a plurality of dispensing boxes, a number of plurality of dispensing boxes being equal to a number of medication dispensing actions taken during at the particular time over a time period of the drug treatment regime, each of the plurality of dispensing boxes including a plurality of walls defining an interior that extends vertically and stores at least one of the plurality of dosage containers, wherein the plurality of dosage containers in a first dispensing box of the plurality of dispensing boxes need not store a same drug type or a same drug dosage as drug containers in the first dispensing box or drug containers in another drug dispensing box, a dispensing aperture located in at least one of plurality of walls to allow a single one of the dosage containers to be removed from the interior of any of the plurality of dispensing boxes at one time, wherein a front wall of the plurality of walls of each dispensing box includes a front wall, and wherein the front wall includes:

a level indicator to view a remaining amount of drug in the interior of the box, a removed amount of drug from the box, or both, and a dose tracker to allow a user to indicate the drug dosage taken from an associated dispensing box; and a connector to secure the plurality of dispensing boxes together that represents a drug therapy regimen.

15. The medication dispensing system of claim 14, wherein the dispensing aperture is positioned adjacent a bottom of each of plurality of dispensing boxes with the dosage container at the dispensing aperture being associated with a topmost indicator at the level indicator and an upper one of the dose trackers such that the last dosage container is aligned with the indicator for the dosage container at the dispensing aperture.

16. The medication dispensing system of claim 15, wherein at least one of the plurality of dosage containers includes a medication storage bag.

17. The medication dispensing system of claim 16, wherein the connector includes a foot assembly to assist in holding the plurality of boxes upright.

18. The medication dispensing system of claim 17, wherein the foot assembly includes at least one side wall that extends along a lateral wall of an outer most one of the plurality of box walls.

19. The medication dispensing system of claim 17, wherein the dosage containers include a closed dosage boxes that each contains a scheduled dose of medication.

20. The medication dispensing system of claim 17, wherein the plurality of dispensing boxes store therein a set of dosage containers containing a drug dosage to be taken at same time each day.

21. The medication dispensing system of claim 17, wherein the foot assembly is moveable between a stand-assist position with the dispensing aperture being uncovered and a retracted position for transportation, wherein the foot assembly closes the dispensing aperture in the retracted position to prevent the dosage container from exiting the dispensing box through the dispensing aperture.

22. The medication dispensing system of claim 21, wherein the connector includes a backing behind the plurality of dispensing boxes and the foot assembly is pivotably joined to the backing to allow the foot assembly to pivot from the retracted position to the stand assist position.

* * * * *